US006412411B1

(12) United States Patent
Sugiyama et al.

(10) Patent No.: US 6,412,411 B1
(45) **Date of Patent: *Jul. 2, 2002**

(54) POSITION CORRECTING METHOD AND APPARATUS FOR INK FOUNTAIN KEY IN PRINTING PRESS

(75) Inventors: Hiroyuki Sugiyama; Masaaki Ishida, both of Ibaragi (JP)

(73) Assignee: Komori Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/414,150

(22) Filed: Oct. 7, 1999

(30) Foreign Application Priority Data

Oct. 7, 1998 (JP) ..... 10-285686

(51) Int. Cl.[7] ..... B41F 31/02

(52) U.S. Cl. ..... 101/365; 101/211

(58) Field of Search ..... 101/148, 202, 101/204–211, 315, 321, 324, 326, 330, 331, 335, 340, 344, 347, 348, 349.1, 350.1, 350.5–351.4, 356, 360, 363, 364–367

(56) References Cited

U.S. PATENT DOCUMENTS 5,138,944 A * 8/1992 Rancourt et al. ..... 101/365
5,163,368 A * 11/1992 Pensavecchia et al. ..... 101/136

FOREIGN PATENT DOCUMENTS

| | | | |
|---|---|---|---|
| DE | 2011 979 | 3/1970 | ..... B41F/33/11 |
| DE | 30 40 455 A | 10/1980 | ..... B41F/33/10 |
| DE | 32 26 144 A | 7/1982 | ..... B41F/33/10 |
| DE | 37 08 652 A | 3/1987 | ..... B41F/33/10 |
| DE | 41 00 798 A | 1/1991 | ..... B41F/33/10 |
| EP | 0 741 029 A | 11/1996 | ..... B41F/33/00 |

* cited by examiner

*Primary Examiner*—Eugene Eickholt
(74) *Attorney, Agent, or Firm*—Blakely Sokoloff Taylor & Zafman

(57) ABSTRACT

In a method of correcting a position of each ink fountain key, a position of an ink fountain key is set as a present position with reference to a home position by using print data including an image area ratio of a reference plate having a predetermined image. A printing product is printed by using the reference plate with the ink fountain key being set at the present position. A density of each of respective areas, corresponding to the ink fountain keys, of the obtained printing product is measured. One of the home position and the present position of the ink fountain key is corrected on the basis of a difference between the measured density of the corresponding area and a reference density stored in advance. A position correcting apparatus is also disclosed.

21 Claims, 23 Drawing Sheets

POSITION CORRECTING METHOD AND APPARATUS FOR INK FOUNTAIN KEY IN PRINTING PRESS

BACKGROUND OF THE INVENTION

The present invention relates to a position correcting method and apparatus for an ink fountain key that correct the home position/present position of an ink fountain key in a printing press when adjusting the opening amount (position) of the ink fountain key.

FIG. 19 shows the schematic arrangement of an ink supply unit in each printing unit of a rotary printing press. Referring to FIG. 19, the ink supply unit has an ink fountain 1, an ink 2 stored in the ink fountain 1, an ink fountain roller 3, a plurality of ink fountain keys 4 aligned in the axial direction of the ink fountain roller 3, an ink ductor roller 5, an ink roller group 6, a plate 7, and a plate cylinder 8.

FIG. 20 shows the outline of a general four-color rotary printing press. Referring to FIG. 20, printing units 9-1 to 9-4 perform printing in units of colors. The ink supply unit shown in FIG. 19 is separately provided in each of the printing units 9-1 to 9-4.

In the printing press having the above arrangement, the ink 2 in the ink fountain 1 is supplied to the ink fountain roller 3 by adjusting the opening amount of the ink fountain keys 4. The ink supplied to the ink fountain roller 3 is supplied to the plate 7 through the ink roller group 6 by the ducting operation of the ink ductor roller 5. A print sheet supplied from a feeder is printed with the ink supplied to the plate 7.

The opening amount (present position) of the ink fountain keys 4 with respect to the ink fountain roller 3 is set by using print data created in accordance with the image area ratio or the like of each of areas, corresponding to the ink fountain keys 4, of the plate 7 with reference to the home position (fully open or fully closed position) of the ink fountain keys 4 stored in advance. In this case, if printing is performed over a long period of time, the home position of the ink fountain keys 4 changes due to various reasons.

When the home position of the ink fountain keys 4 changes, the actual opening amount of the ink fountain keys 4 also changes, and a correct ink amount cannot be supplied to the plate 7. Then, the color tone of the printing product becomes largely different from a desired one, making it very difficult to obtain a printing product having a desired color tone.

Conventionally, the home position and present position of the ink fountain keys 4 are adjusted by the operator by measuring the ink thickness on the ink fountain roller 3 with a measurement unit or confirming the ink color.

In this adjusting method, the home position and present position of the ink fountain keys 4 are adjusted while measuring the ink thickness or visually confirming the ink color. This adjusting method is accordingly very difficult and takes a long period of time.

SUMMARY OF THE INVENTION

It is an object of the present invention to provide a position correcting method and apparatus for an ink fountain key, which can adjust the home position/present position of the ink fountain key easily within a short period of time.

In order to achieve the above object, according to the present invention, there is provided a method of correcting a position of an ink fountain key in a printing press, in which an amount of ink to be supplied is adjusted by adjusting a position of each of a plurality of ink fountain keys with reference to a home position, comprising the steps of setting a position of the ink fountain key as a present position with reference to the home position by using print data including an image area ratio of a reference plate having a predetermined image, printing a printing product by using the reference plate with the ink fountain key being set at the present position, measuring a density of each of respective areas, corresponding to the ink fountain keys, of the obtained printing product and correcting one of the home position and the present position of the ink fountain key on the basis of a difference between the measured density of a corresponding area and a reference density stored in advance.

DESCRIPTION OF THE PREFERRED EMBODIMENTS

The present invention will be described in detail with reference to the accompanying drawings.

First Embodiment

Figure 2:
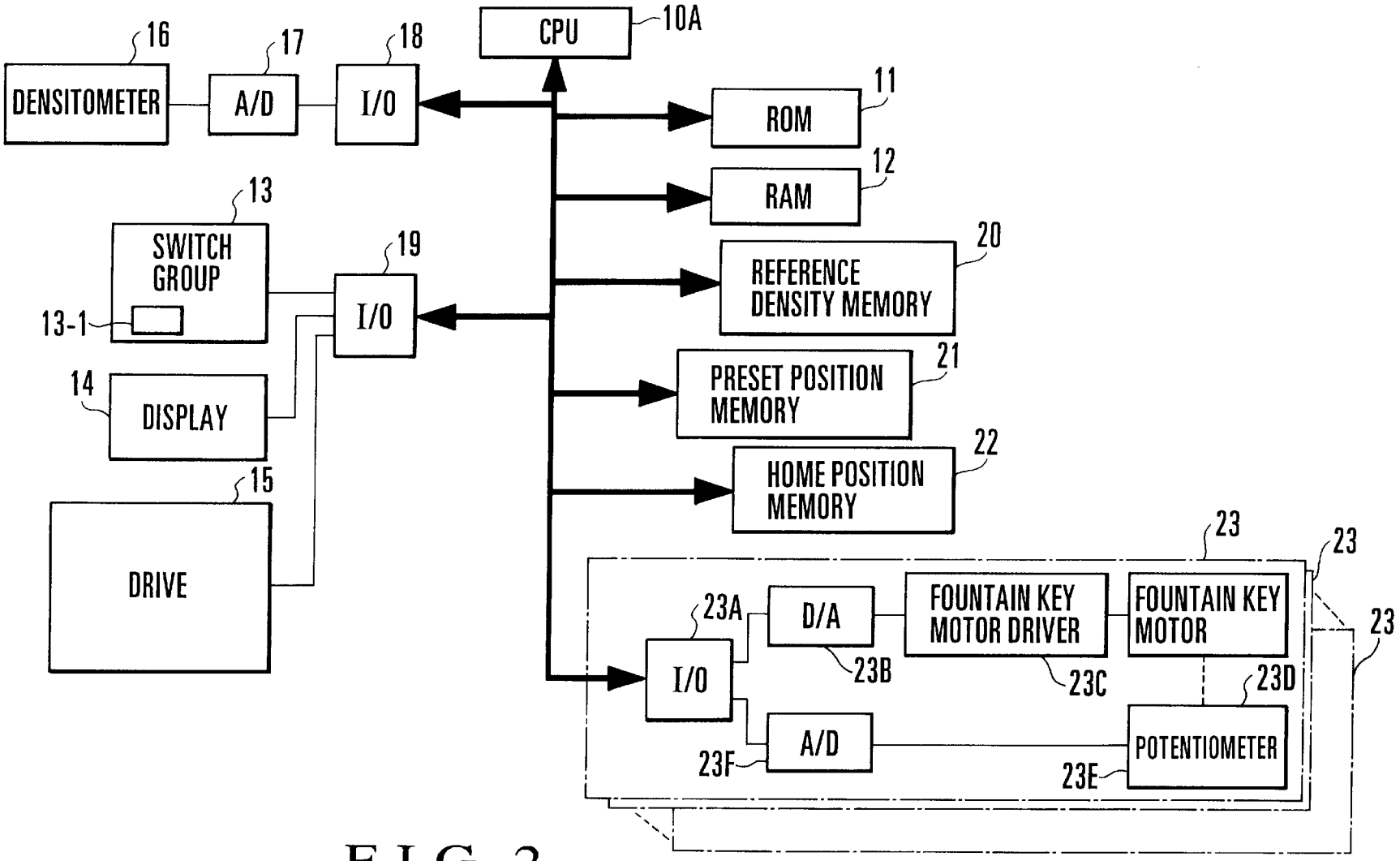
FIG. 2 is a block diagram of the home position correcting apparatus for ink fountain keys according to the first embodiment of the present invention.
Figure 19:
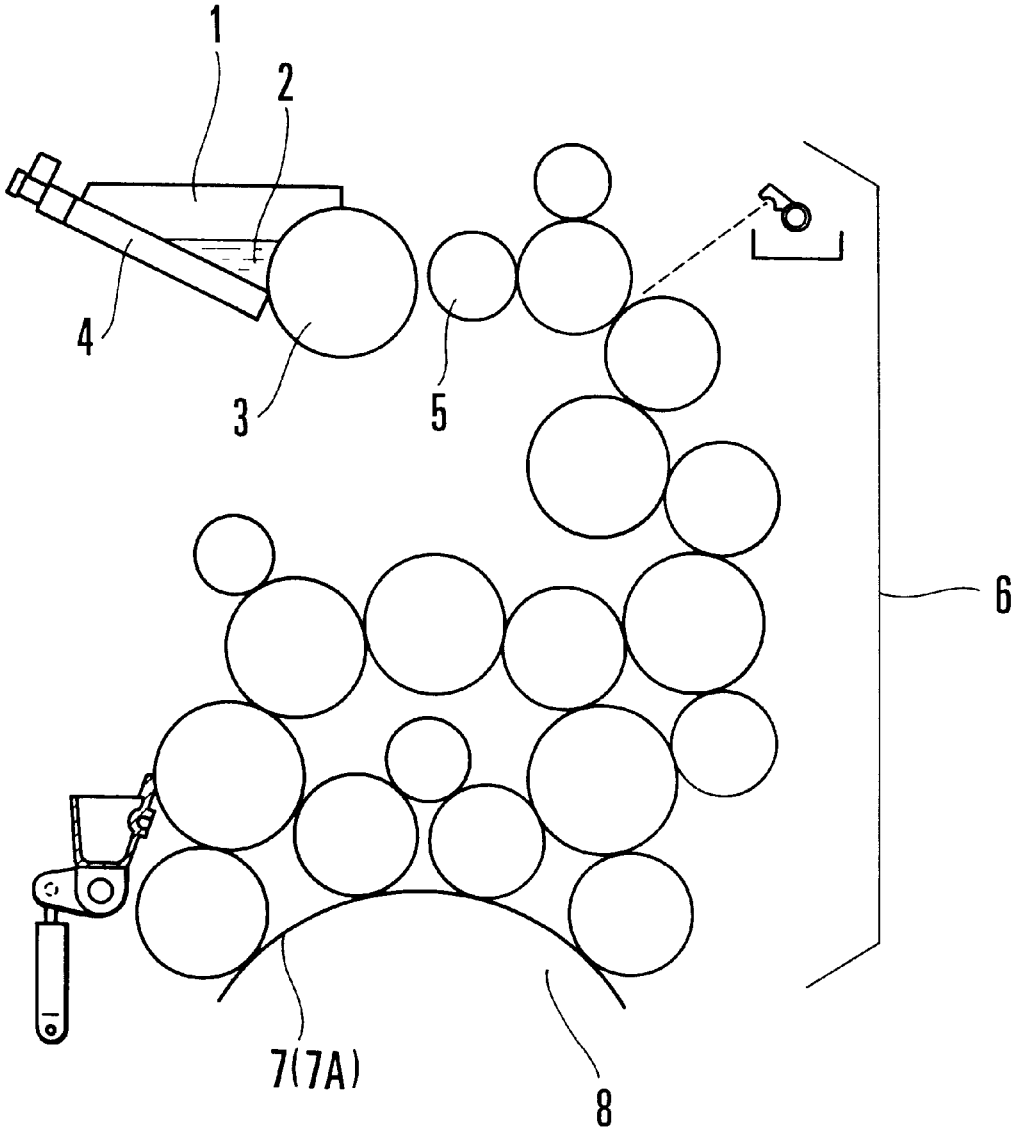
FIG. 19 is a diagram showing the schematic arrangement of an ink supply unit in each printing unit of a rotary printing press.
Figure 20:
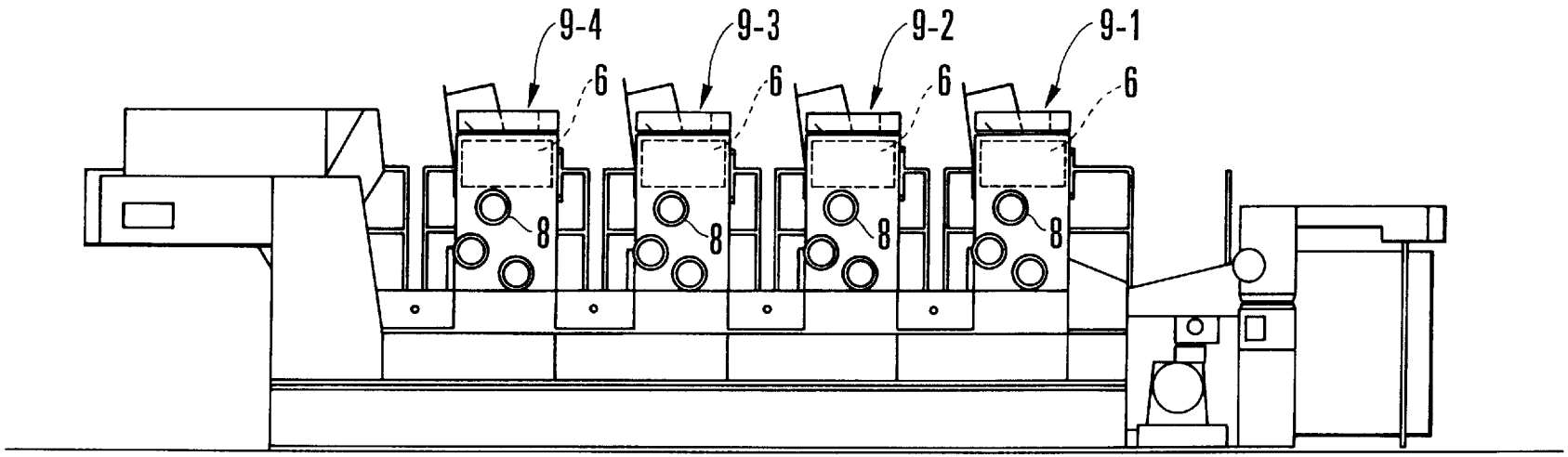
FIG. 20 is a side view showing the schematic arrangement of a four-color sheet-fed rotary printing press.

The first embodiment is described here with reference to FIGS. 2 and 19. FIG. 2 shows the home position correcting apparatus for ink fountain keys according to the first embodiment of the present invention. Referring to FIG. 2, this apparatus includes a CPU (Central Processing Unit) 10A, a ROM (Read Only Memory) 11, a RAM (Random Access Memory) 12, a switch group 13, a display 14, a drive 15 such as a floppy disk drive or magnetic card drive, a densitometer 16, an A/D (Analog to Digital) converter 17, input/output (I/O) interfaces 18 and 19, a reference density memory 20, a preset position memory 21, a home position memory 22, and a plurality of ink fountain key drivers 23. The switch group 13 includes a home position setting switch 13-1. The drive 15 drives a storage medium such as a floppy disk or magnetic card. The reference density memory 20 stores a reference density based on a testing plate in advance. The preset position memory 21 stores the target position of the ink fountain keys 4, i.e., the present position of the ink fountain key with reference to the home position. The home position memory 22 stores the home position of the ink fountain keys 4. The ink fountain key drivers 23 drive the ink fountain keys 4 (FIG. 19).

The plurality of ink fountain key drivers 23 are provided in units of the ink fountain keys 4 to separately adjust the opening amounts of the respective ink fountain keys 4 with respect to an ink fountain roller 3. Each ink fountain key driver 23 is comprised of an input/output (I/O) interface 23A, a D/A converter 23B, a fountain key motor driver 23C, a fountain key motor 23D, a potentiometer 23E provided to the fountain key motor 23D, and an A/D converter 23F.

Figure 3:
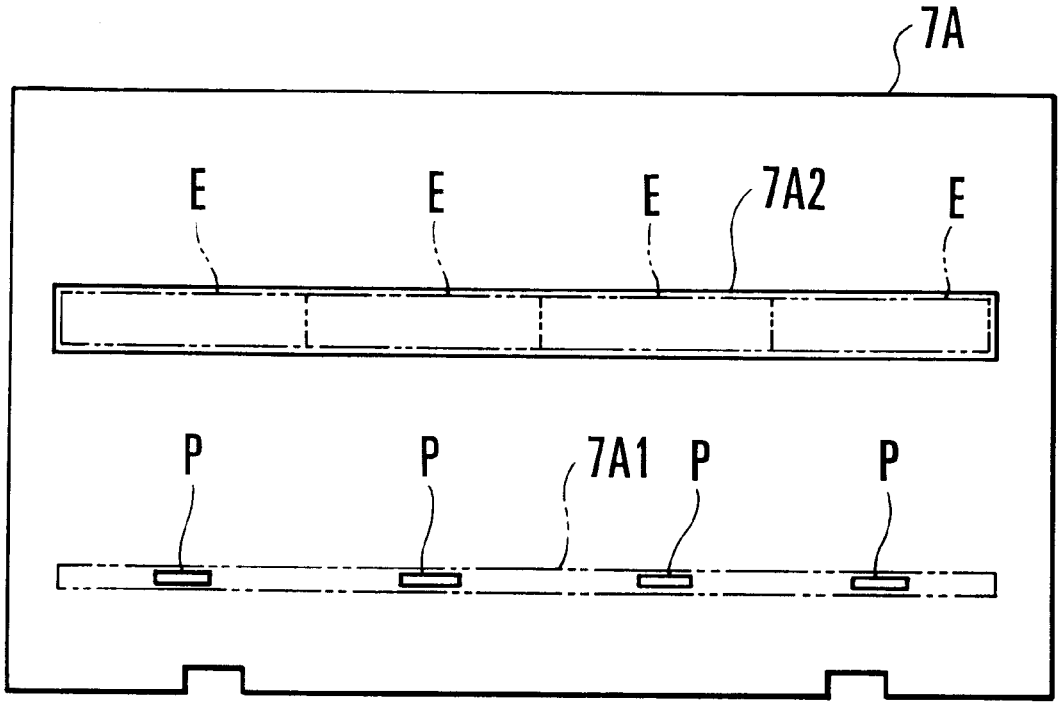
FIG. 3 is a plan view of a testing plate used in the home position correcting apparatus shown in FIG. 2.

In the home position adjusting apparatus descried above, a testing plate 7A is mounted on the outer surface of a plate cylinder 8. As shown in FIG. 3, the testing plate 7A is formed with a color patch portion 7A1 and a home position adjusting image portion 7A2 in a direction perpendicular to the sheet convey direction (axial direction of the plate cylinder 8). The color patch portion 7A1 is a known belt-like image portion used for printing quality measurement. In the color patch portion 7A1, a plurality of patches p are formed within respective areas E corresponding to the ink fountain keys 4, at predetermined gaps from each other in the axial direction of the plate cylinder 8. The patches p of the color patch portion 7A1 are used to measure the density of the printing sample.

The home position adjusting image portion 7A2 is provided parallel to the color patch portion 7A1 to have a belt-like shape. The image area ratios in the respective areas E corresponding to the ink fountain keys 4 are set to be equal to those of the color patch portion 7A1. The image area ratios in the home position adjusting image portion 7A2 are measured in units of areas E, and the measured image area ratios are used when setting the ink fountain keys 4. The patches p of the color patch portion 7A1 are provided to correspond to the areas E of the home position adjusting image portion 7A2.

The density of each patch p of the color patch portion 7A1 having the same image area ratio as that of the testing plate 7A is set in the reference density memory 20 as the reference density. The home position adjusting image portion 7A2 is set to have an image area ratio of a certain degree. This is because if the opening amounts of the ink fountain keys 4 are zero, no ink is supplied to the ink supply unit, and normal printing cannot be performed.

The correcting operation of the home position correcting apparatus having the above arrangement as shown in FIG. 2 will be described further with reference to the flow chart shown in FIG. 1 along with features described in FIGS. 3 and 19.

To correct the home positions of the ink fountain keys 4, the operator measures the image area ratio of the home position adjusting image portion 7A2 of the testing plate 7A with a plate area ratio meter to obtain print data. More specifically, the operator measures the image area ratios of the respective areas E, corresponding to the ink fountain keys 4, of the home position adjusting image portion 7A2, and creates print data corresponding to the ink fountain keys 4 on the basis of the measured image area ratios.

The operator then inputs the created print data to the home position correcting apparatus to set the opening amount (present position) of each ink fountain key 4 (step S101). More specifically, the CPU 10A reads out the home position (present home position) of the ink fountain key 4 stored in the home position memory 22 in advance. The opening amount of the ink fountain key 4 is set by using the print data with reference to the read home position. The CPU 10A also stores the preset opening amount of the ink fountain key 4 in the preset position memory 21 as the target position of the ink fountain key 4.

With the testing plate 7A being set on the plate cylinder 8, the operator performs printing to acquire printing samples (step S102). The density of the printing sample acquired from each patch p of the color patch portion 7A1 is measured by using the densitometer 16 (step S103), and is supplied to the CPU 10A through the A/D converter 17 and I/O interface 18. On the basis of the data supplied from the densitometer 16, the CPU 10A checks whether the density (measured density) of the patch p for each ink fountain key 4 coincides with the corresponding reference density stored in advance in the reference density memory 20 (step S104).

If the measured density and the reference density do not coincide with each other, i.e., if the difference between the measured density and the reference density is not zero or does not fall within a predetermined range, the CPU 10A determines that an error has occurred in the home position of the ink fountain key 4 corresponding to the patch p of the color patch portion 7A1. A description will be made on an assumption that the measured density and the reference density do not coincide with each other in all the patches p of the color patch portion 7A1.

The CPU 10A sequentially performs fine adjustment of all the ink fountain keys 4 (step S105). More specifically, the opening amount of each ink fountain key 4 is adjusted by the corresponding ink fountain key driver 23 so that the measured density and the reference density coincide with each other.

After that, the operator performs printing again with the testing plate 7A being set on the plate cylinder 8, and acquires a printing sample from each patch p of the color patch portion 7A1 (step S106). The CPU 10A measures the density of the obtained printing sample in the same manner as in step S103 (step S107) to check whether the measured density of the patch p for the corresponding ink fountain key 4 coincides with the reference density (step S108).

Steps S105 to S108 are repeated until the measured density coincides with the reference density in all the patches p corresponding to the ink fountain keys 4. When the measured density coincides with the reference density in all the patches p, the operator turns on the home position setting switch 13-1 (step S109). The CPU 10A accordingly reads out the target position (the preset position with reference to the home position) of the ink fountain key stored in the preset position memory 21 (step S110), and successively reads out the present position of the ink fountain key 4 fine-adjusted in step S105 (step S111). The CPU 10A then calculates the difference between the target position and the present position of the ink fountain key 4 (step S112).

The CPU 10A reads out the present home position of the ink fountain key 4 from the home position memory 22 (step S113). The CPU 10A then corrects the present home position of the ink fountain key 4 obtained in step S113 by an amount corresponding to the difference between the target position and the present position of the ink fountain key 4 obtained in step S112 (step S114).

More specifically, the home position of the ink fountain key 4 is corrected using as the correction value the difference between the target position and the present position of the ink fountain key 4 obtained in step S112. The CPU 10A writes the corrected home position in the home position memory 22 as the present home position of the ink fountain key 4 (step S115). The CPU 10A successively writes the corrected home position of the ink fountain key 4 in a storage medium through the drive 15 to save it in an external unit (step S116).

If the measured density and the reference density coincide with each other in step S104, the flow advances to step S116 without performing correction.

According to this embodiment, after the correction, the target position of the ink fountain key 4 is set with reference to the corrected home position. Therefore, a printing product having a desired color tone can be obtained reliably.

Second Embodiment

Figure 4:
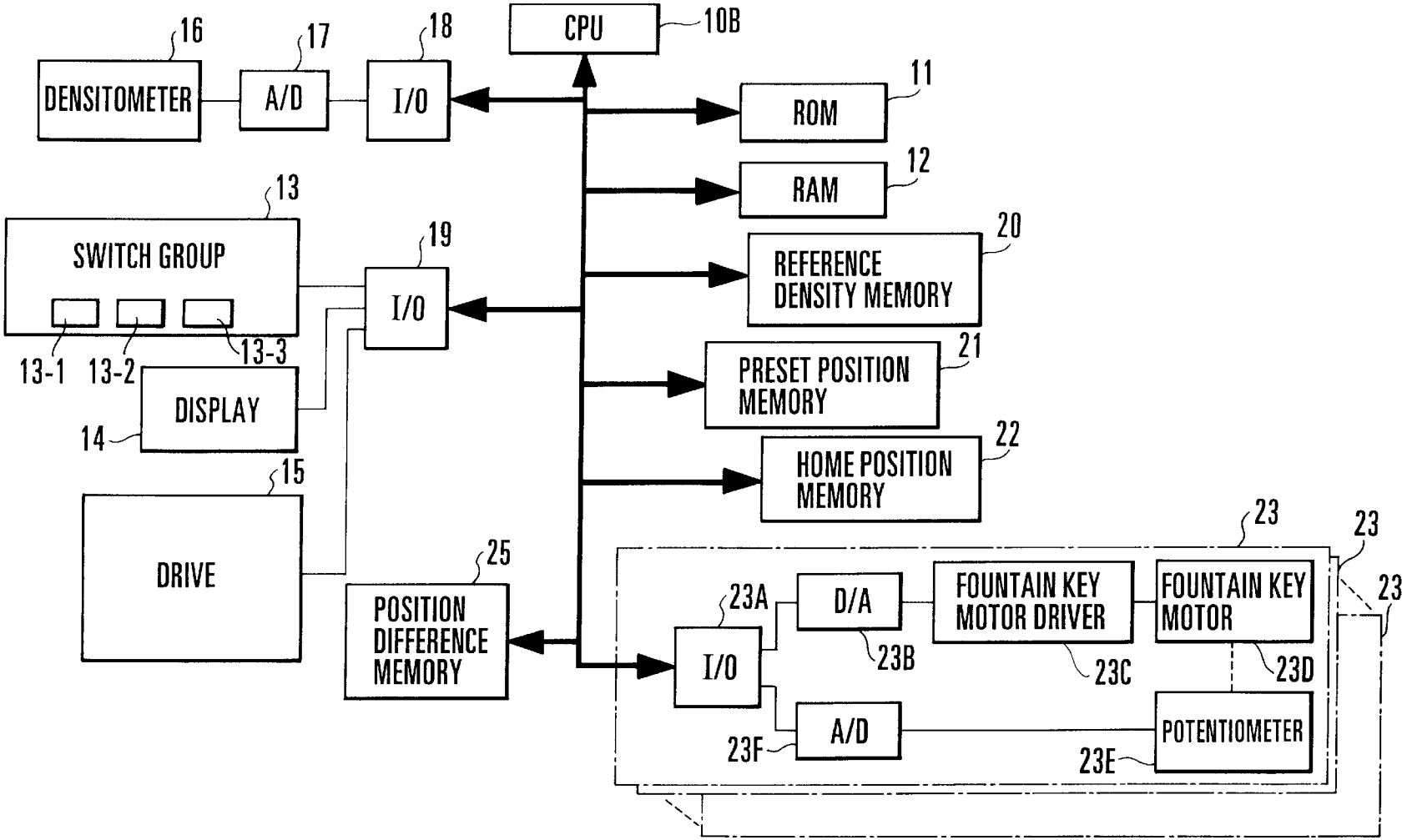
FIG. 4 is a block diagram of a home position correcting apparatus for ink fountain keys according to the second embodiment of the present invention.

FIG. 4 shows a home position correcting apparatus according to the second embodiment of the present invention. In FIG. 4, the same reference numerals as in FIGS. 2 and 19 denote the same or equivalent constituent elements, and a detailed description thereof will be omitted. In the home position correcting apparatus of this embodiment, in addition to the arrangement of FIG. 2, a position difference memory 25 for storing the position difference (to be described later) of each ink fountain key 4 is provided. A switch group 13 has, in addition to a home position setting switch 13-1, a home position correction value calculating switch 13-2 and a home position reset switch 13-3.

The correcting operation of the home position correcting apparatus having the above arrangement will be described with reference to the flow chart shown in FIG. 5. In this home position correcting apparatus as well, a testing plate 7A identical to that shown in FIG. 3 is used as a plate to be mounted on a plate cylinder 8. The image area ratios of respective areas E, corresponding to the ink fountain keys 4, of the testing plate 7A are measured in the same manner as in the first embodiment, and print data for the ink fountain keys 4 is created on the basis of the measured image area ratios.

Figure 1:
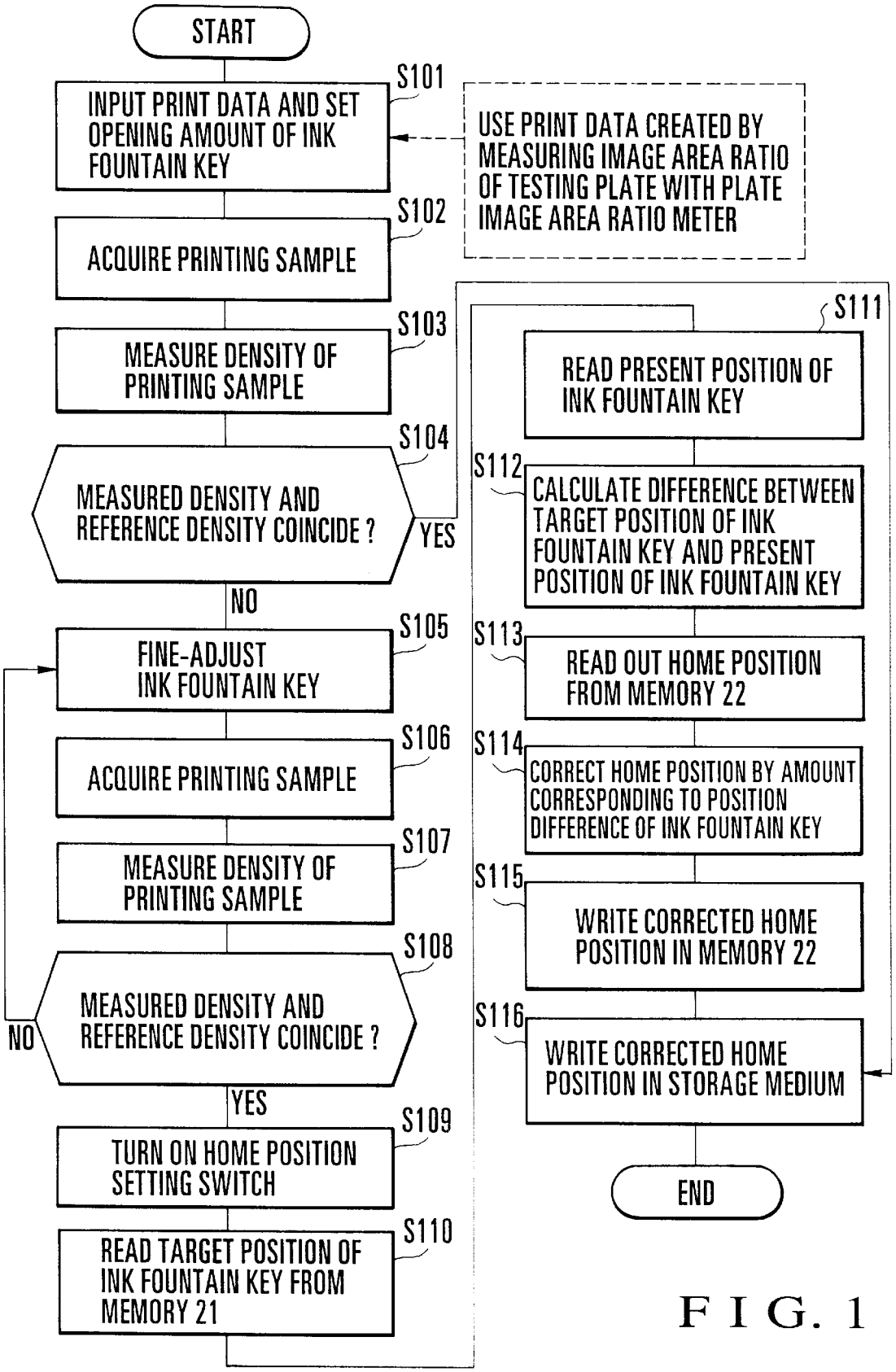
FIG. 1 is a flow chart explaining the correcting operation of the home position correcting apparatus shown in FIG. 2.

First, in steps S501 to S508, a CPU 10B performs the same operations as in steps S101 to S108 in FIG. 1. When all the measured densities coincide with the corresponding reference densities in step S508, the operator turns on the home position correction value calculating switch 13-2 (step S509). Accordingly, the CPU 10B reads out the target position of each ink fountain key 4 stored in a preset position memory 21 (step S510), and successively reads the present position of the ink fountain key 4 (step S511).

Next, a difference between positions where ink fountain keys 4-l to 4-n are to be and the present position is calculated (S512). The CPU 10B then writes the difference between the target position of the ink fountain key 4 obtained in step S510 and the present position of the same obtained in step S511 in the position difference memory 25 (step S513). The CPU 10B writes the difference between the target position and the present position of the ink fountain key 4 obtained in step S512 in a storage medium through a drive 15 (step S514).

After that, to perform actual printing, the operator turns on the home position setting switch 13-1 (step S515). Accordingly, the CPU 10B reads out the present home position of the ink fountain key 4 from a home position memory 22 (step S516), and successively reads out the difference between the target position and the present position of the ink fountain key 4 from the position difference memory 25 (step S517).

The CPU 10B corrects the present home position of the ink fountain key 4 obtained in step S516 by an amount corresponding to the position difference of the ink fountain keys 4 obtained in step S517 (step S518). More specifically, the home position of the ink fountain keys 4 is corrected by the position difference of the ink fountain key 4 obtained in step S517 as a correction value. The CPU 10B then writes the corrected home position in the home position memory 22 as the present home position (step S519). In this case, the CPU 10B keeps the home position before correction in the home position memory 22 as the original home position.

According to this embodiment, when the home position setting switch 13-1 is turned on in step S515, the opening amount of the ink fountain key 4 is controlled with reference to the home position corrected in step S518.

Figure 5:
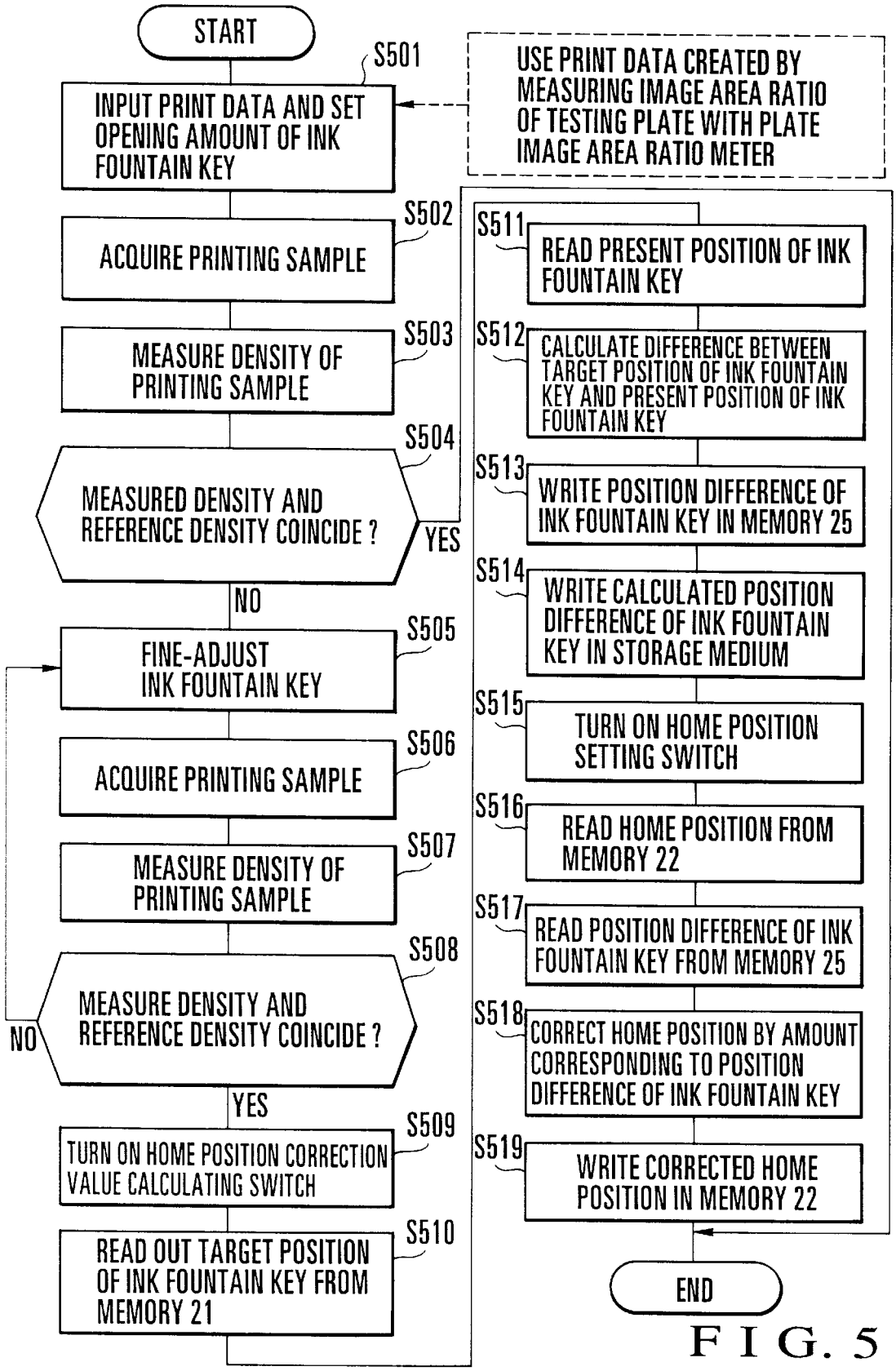
FIG. 5 is a flow chart explaining the correcting operation of the home position correcting apparatus shown in FIG. 4.

Although not shown in the flow chart of FIG. 5, when the operator wishes to restore the ink fountain key 4 to the original home position, he turns on the home position reset switch 13-3. Then, the present home position (corrected home position) in the home position memory 22 is updated to the original home position (home position before correction), and the opening amount of the ink fountain key 4 can be controlled with reference to the original home position.

Third Embodiment

Figure 6:
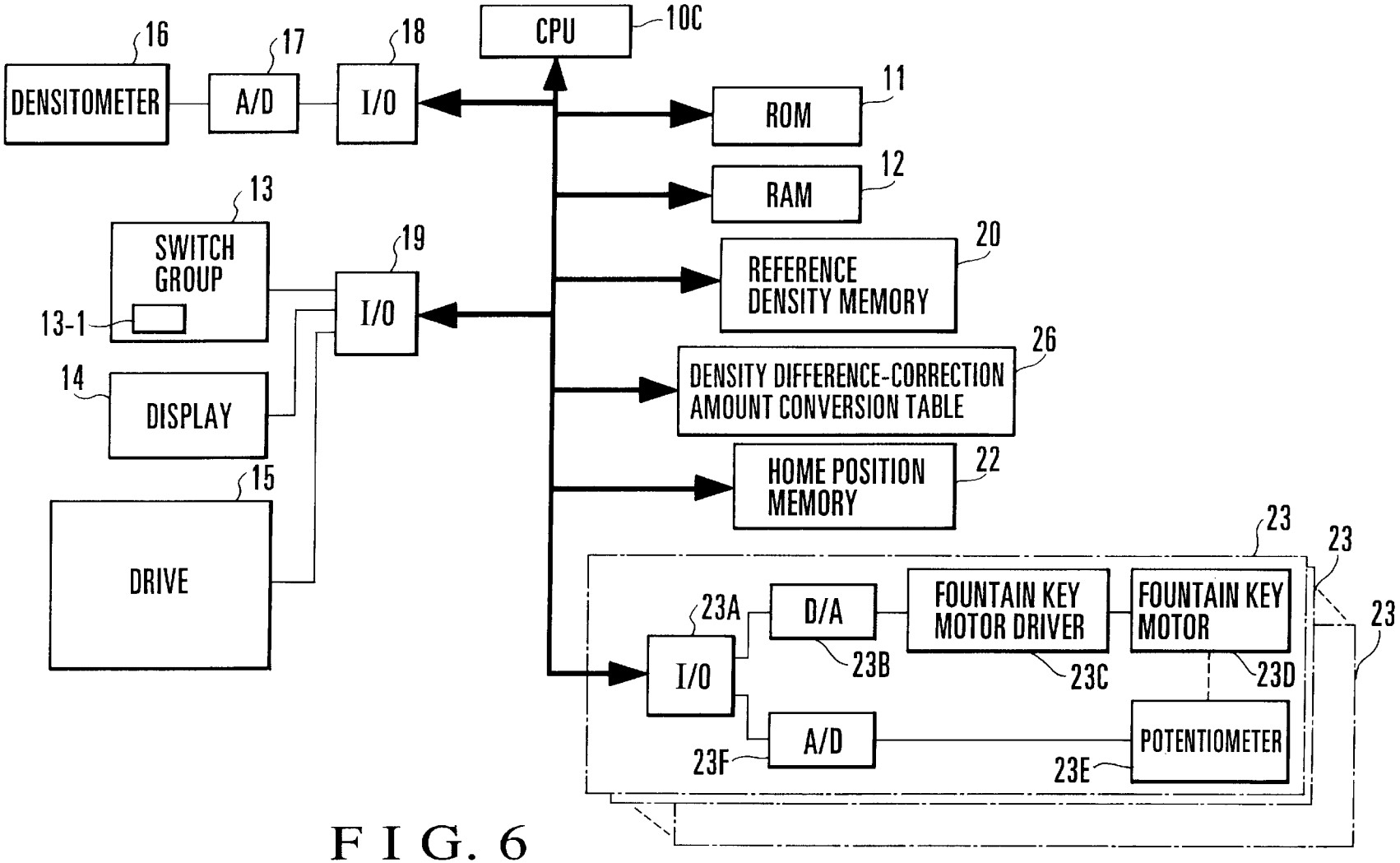
FIG. 6 is a block diagram of a home position correcting apparatus for ink fountain keys according to the third embodiment of the present invention.

FIG. 6 shows a home position correcting apparatus for ink fountain keys according to the third embodiment of the present invention. In FIG. 6, the same reference numerals as in FIG. 2 denote the same or equivalent constituent elements, and a detailed description thereof will be omitted. In the home position correcting apparatus of this embodiment, in place of the preset position memory 21 of FIG. 2, a density difference-correction amount conversion table 26 is arranged.

The correcting operation of the home position correcting apparatus having the above arrangement will be described with reference to the flow chart shown in FIG. 7. In this home position correcting apparatus as well, a testing plate 7A identical to that shown in FIG. 3 is used as a plate to be mounted on a plate cylinder 8. The image area ratios of respective areas E, corresponding to ink fountain keys 4, of the testing plate 7A are measured in the same manner as in the first embodiment, and print data for the ink fountain keys 4 is created on the basis of the measured image area ratios.

First, in steps S701 to S703, a CPU 10C performs the same operations as in steps S101 to S103 of FIG. 1. The operator then turns on a home position setting switch 13-1 (step S704). When the home position setting switch 13-1 is turned on, the CPU 10C calculates the difference (density difference) between the density (measured density) of the patch p for each ink fountain key 4 and a corresponding reference density stored in a reference density memory 20 in advance (step S705). The home position correction amount of the ink fountain key 4 corresponding to the density difference is obtained by looking up the density difference-correction amount conversion table 26 (step S706).

The CPU 10C then reads out the present home position of the ink fountain key 4 from a home position memory 22 (step S707) and corrects the read present home position of the ink fountain key 4 by an amount corresponding to the home position correction amount obtained in step S706 (step S708). More specifically, the home position of the ink fountain key 4 is correct by the home position correction amount obtained in step S706 as the correction amount. Successively, the CPU 10C writes the corrected home position in the home position memory 22 as the present home position (step S709).

Fourth Embodiment

Figure 8:
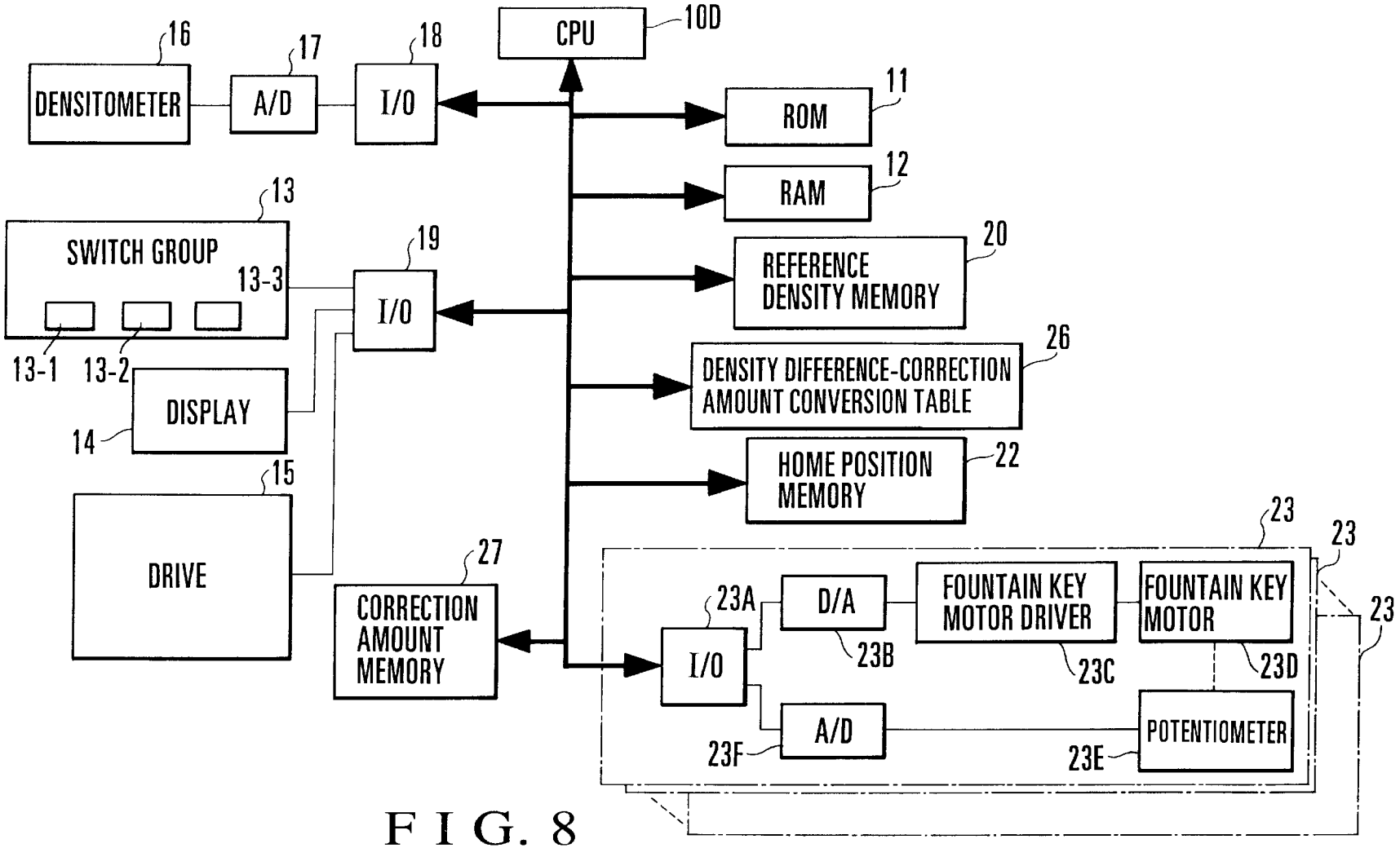
FIG. 8 is a block diagram of a home position correcting apparatus for ink fountain keys according to the fourth embodiment of the present invention.

FIG. 8 shows a home position correcting apparatus for ink fountain keys according to the fourth embodiment of the present invention. In FIG. 8, the same reference numerals as in FIG. 4 denote the same or equivalent constituent elements, and a detailed description thereof will be omitted. In the home position correcting apparatus of this embodiment, a density difference-correction amount conversion table 26 and a correction amount memory 27 for storing the correction amount of each ink fountain key are provided in place of the preset position memory 21 and position difference memory 25 shown in FIG. 4.

The correcting operation of the home position correcting apparatus having the above arrangement will be described with reference to the flow chart shown in FIG. 9. In this home position correcting apparatus as well, a testing plate 7A identical to that shown in FIG. 3 is used as a plate to be mounted on a plate cylinder 8. The image area ratios of respective areas E, corresponding to ink fountain keys 4, of the testing plate 7A are measured in the same manner as in the first embodiment, and print data for the ink fountain keys 4 is created on the basis of the measured image area ratios.

First, in steps S901 to S903, a CPU 10D performs the same operations as in steps S101 to S103 of FIG. 1. The operator then turns on a home position correction value calculating switch 13-2 (step S904). When the home position correction value calculating switch 13-2 is turned on, the CPU 10D calculates the difference (density difference) between the density (measured density) of the patch p for each ink fountain key 4 and a corresponding reference density stored in a reference density memory 20 in advance (step S905). The CPU 10D then calculates the home position correction amount of the ink fountain key 4 corresponding to the density difference by looking up the density difference-correction amount conversion table 26 (step S906). The CPU 10D writes the calculated home position correction amount of the ink fountain key 4 in the correction amount memory 27 (step S907).

After that, to perform actual printing, the operator turns on a home position setting switch 13-1 (step S908). Accordingly, the CPU 10D reads out the present home position of the ink fountain key 4 from a home position memory 22 (step S909) and successively the home position correction amount of the ink fountain key 4 from the correction amount memory 27 (step S910).

The CPU 10D corrects the present home position of the ink fountain key 4 obtained in step S909 by the home position correction amount of the ink fountain keys 4 obtained in step S910 (step 901). More specifically, the home positions of the ink fountain keys 4 are corrected by the home position correction amounts of ink fountain keys 4-l to 4-n obtained in step S910 as the correction values (step S911). The CPU 10D then writes the corrected home position in the home position memory 22 as the present home position (step S912). In this case, the CPU 10D keeps the home position before correction in the home position memory 22 as the original home position.

According to this embodiment, when the home position setting switch 13-1 is turned on in step S908, the opening amount of the ink fountain key 4 is controlled with reference to the home position corrected in step S911.

Figure 9:
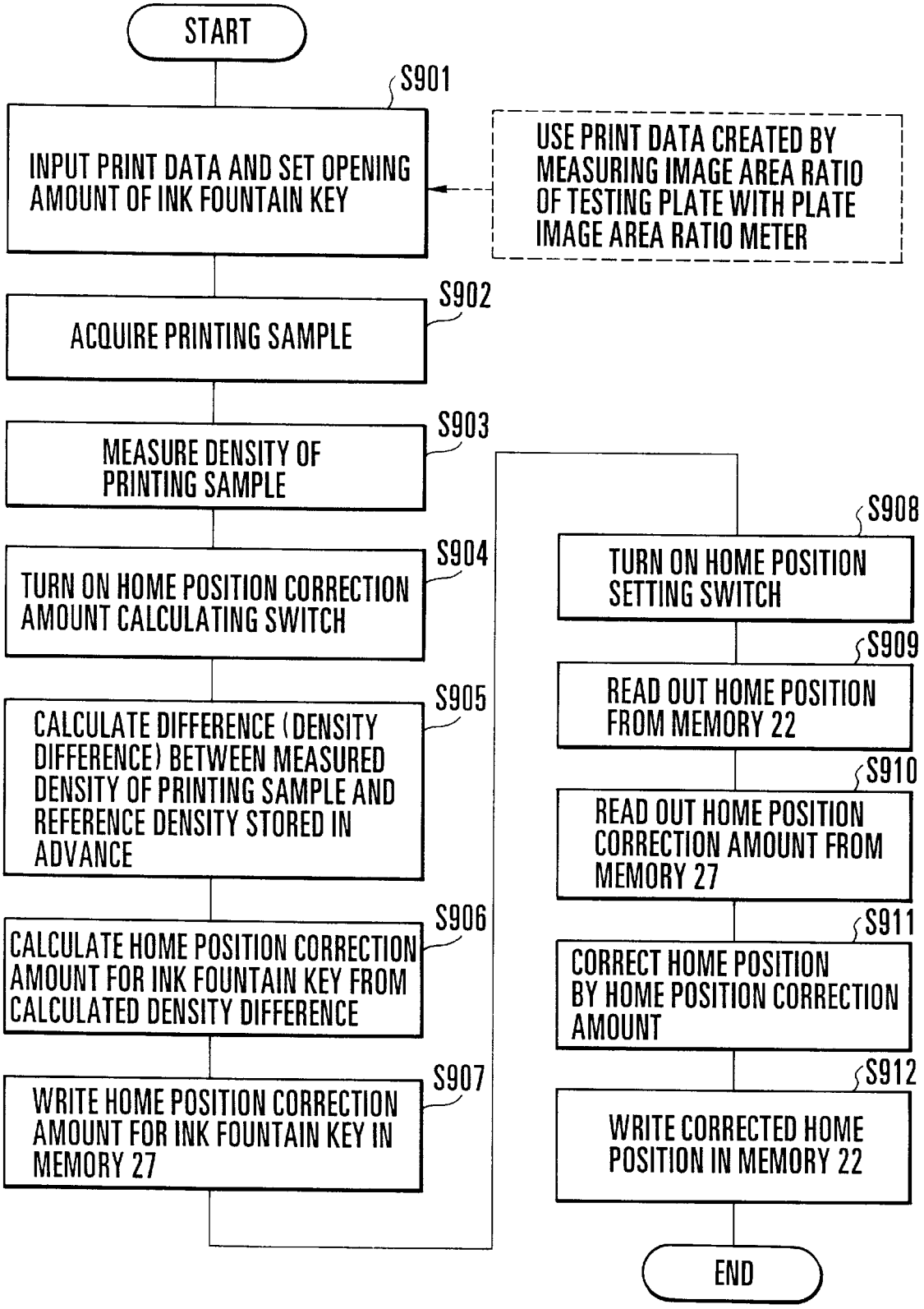
FIG. 9 is a flow chart explaining the correcting operation of the home position correcting apparatus shown in FIG. 8.

Although not shown in the flow chart of FIG. 9, when the operator wishes to restore the home position to the original home position, he turns on the home position reset switch 13-3. Then, the present home position (corrected home position) in the home position memory 22 is updated to the original home position (home position before correction), and the opening amount of the ink fountain key 4 can be controlled with reference to the original home position.

Fifth Embodiment

Figure 10:
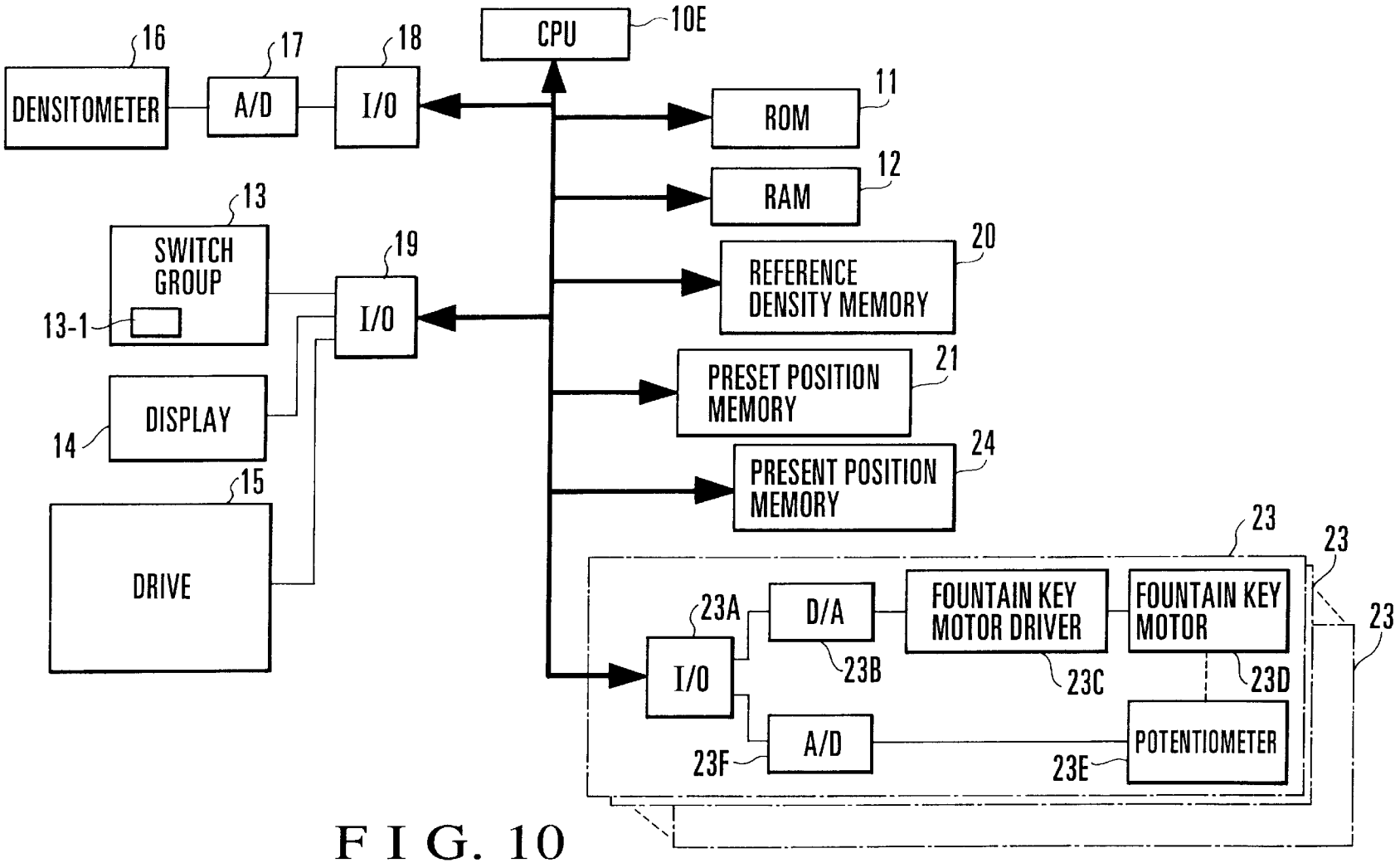
FIG. 10 is a block diagram of a present position correcting apparatus for ink fountain keys according to the fifth embodiment of the present invention.

FIG. 10 shows a present position correcting apparatus for ink fountain keys according to the fifth embodiment of the present invention. In FIG. 10, the same reference numerals as in FIG. 2 denote the same or equivalent constituent elements, and a detailed description thereof will be omitted. In the present position correcting apparatus of this embodiment, a present position memory 24 for storing the present positions of ink fountain keys 4 is arranged in place of the home position memory 22 shown in FIG. 2.

Figure 11:
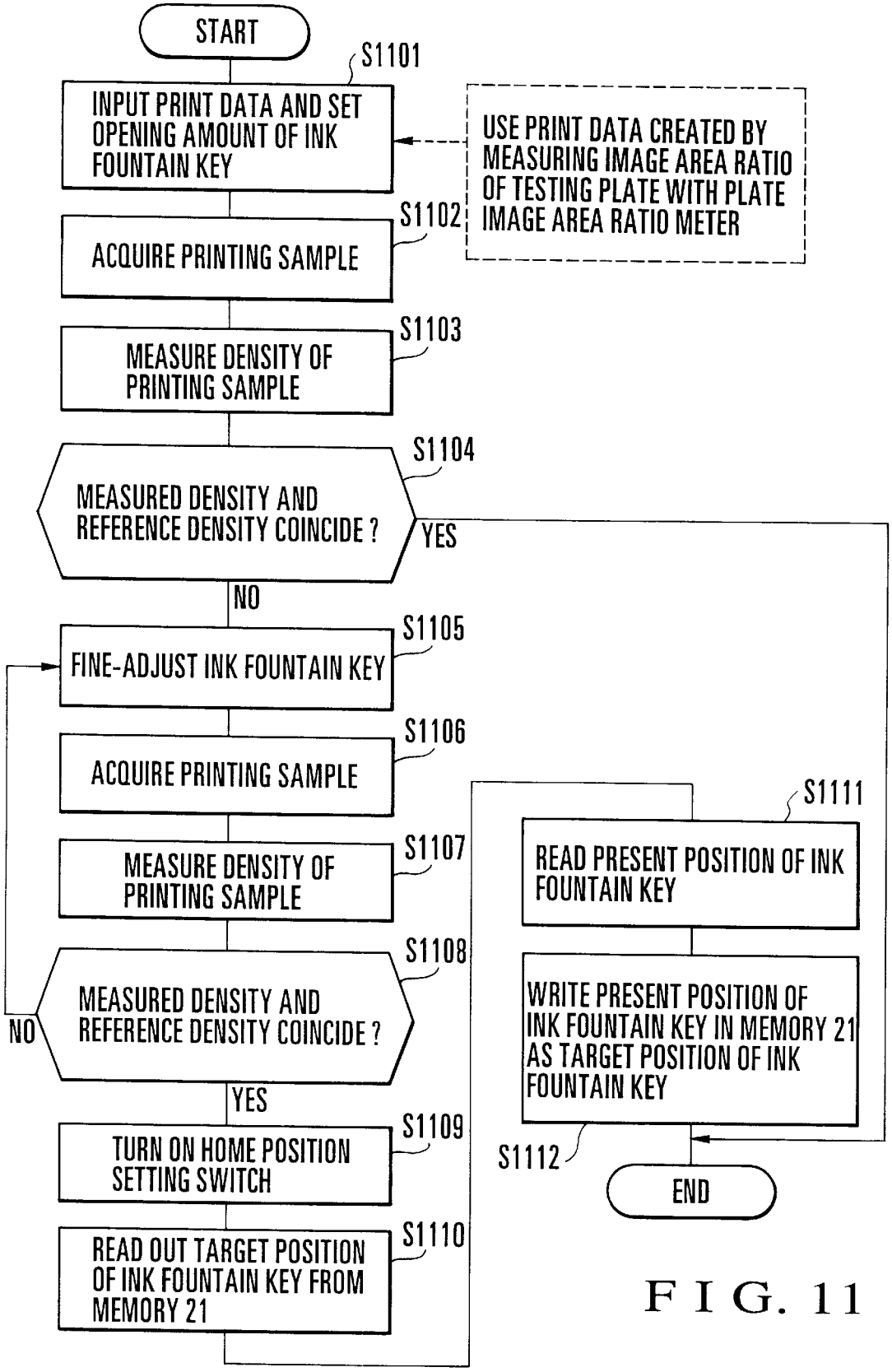
FIG. 11 is a flow chart explaining the correcting operation of the present position correcting apparatus shown in FIG. 10.

The correcting operation of the present position correcting apparatus having the above arrangement will be described with reference to the flow chart shown in FIG. 11. In this present position correcting apparatus as well, a testing plate 7A identical to that shown in FIG. 3 is used as a plate to be mounted on a plate cylinder 8. The image area ratios of respective areas E, corresponding to ink fountain keys 4, of the testing plate 7A are measured in the same manner as in the first embodiment, and print data for the ink fountain keys 4 is created on the basis of the measured image area ratio.

First, in steps S1101 to S1111, a CPU 10E performs the same operations as in steps S101 to S111 of FIG. 1. Step S1110 may be omitted. The CPU 10E then writes the present position of each ink fountain key 4 obtained in step S1111 in a preset position memory 21 as the target position of the ink fountain key 4 (step S1112).

More specifically, the target position of the ink fountain key 4 stored in the preset position memory 21 is updated by the present position of the ink fountain key 4 obtained in step S1111. After that, the opening amount of the ink fountain key 4 is controlled with reference to the target position of the ink fountain key 4 updated in step S1112.

Sixth Embodiment

Figure 12:
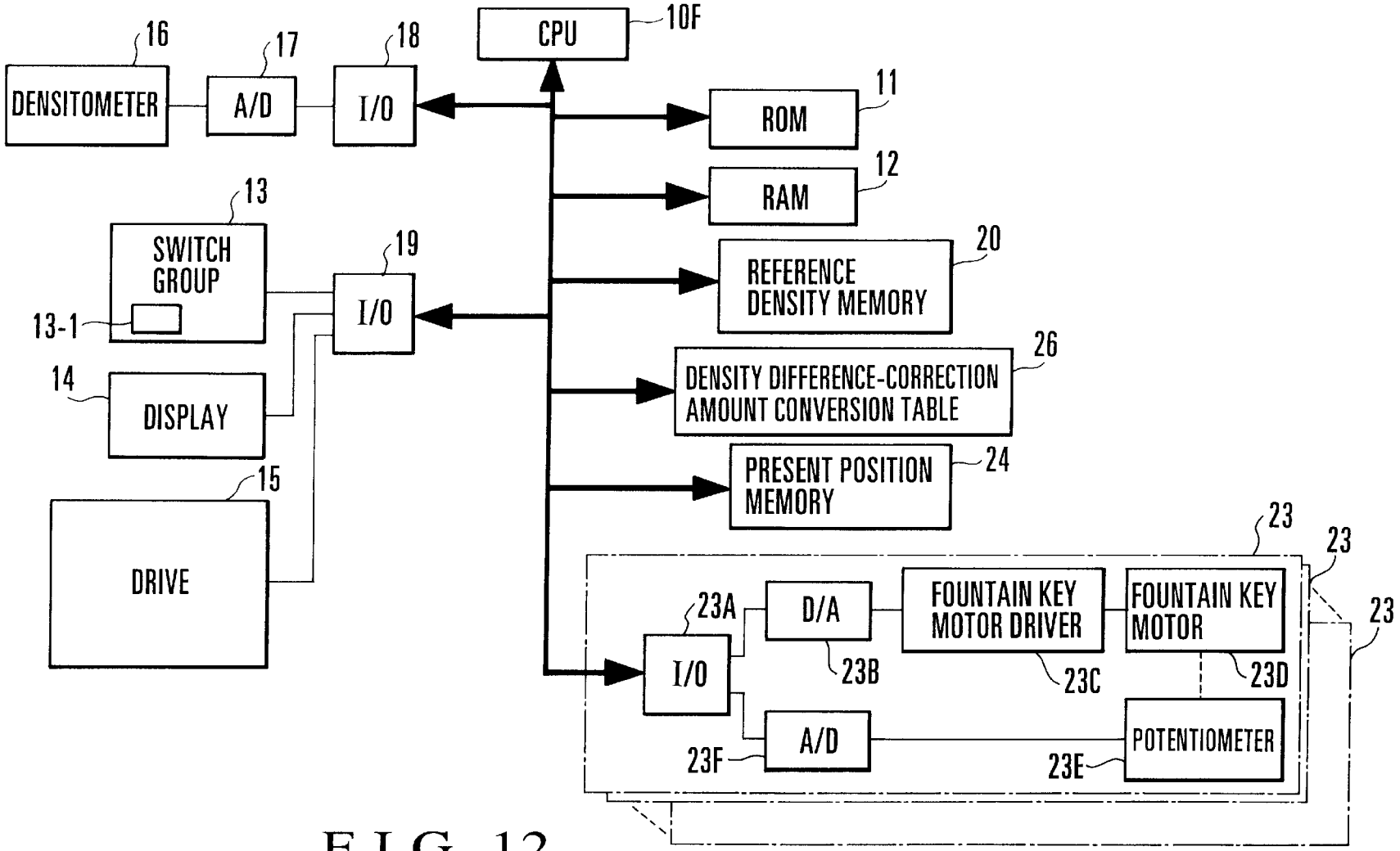
FIG. 12 is a block diagram of a present position correcting apparatus for ink fountain keys according to the sixth embodiment of the present invention.

FIG. 12 shows a present position correcting apparatus for ink fountain keys according to the sixth embodiment of the present invention. In FIG. 12, the same reference numerals as in FIG. 6 denote the same or equivalent constituent elements, and a detailed description thereof will be omitted. In the present position correcting apparatus of this embodiment, a present position memory 24 for storing the present positions of the ink fountain keys 4 is arranged in place of the home position memory 22 shown in FIG. 6.

Figure 13:
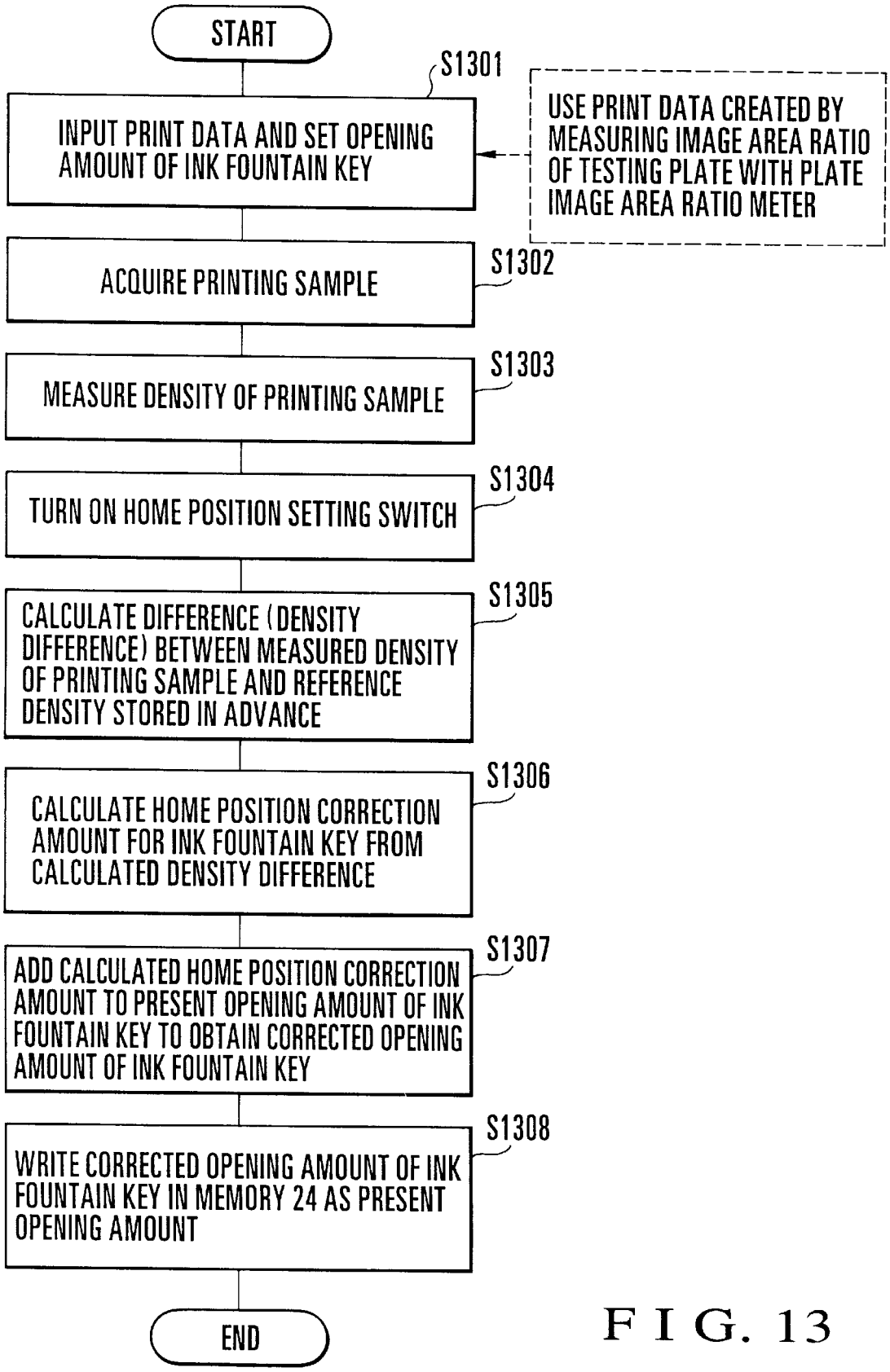
FIG. 13 is a flow chart explaining the correcting operation of the present position correcting apparatus shown in FIG. 12.

The correcting operation of the present position correcting apparatus having the above arrangement will be described with reference to the flow chart shown in FIG. 13. In this present position correcting apparatus as well, a testing plate 7A identical to that shown in FIG. 3 is used as a plate to be mounted on a plate cylinder 8. The image area ratios of respective areas E, corresponding to ink fountain keys 4, of the testing plate 7A are measured in the same manner as in the first embodiment, and print data for the ink fountain keys 4 is created on the basis of the measured image area ratio.

First, in steps S1301 to S1303, a CPU 10F performs the same operations as in steps S101 to S103 of FIG. 1. The operator then turns on a home position setting switch 13-1 (step S1304). When the home position setting switch 13-1 is turned on, the CPU 10F calculates the difference (density difference) between the density (measured density) of the patch p for each ink fountain key 4 and a corresponding reference density stored in a reference density memory 20 in advance (step S1305). The home position correction amount of the ink fountain key 4 corresponding to the density difference is obtained by looking up a density difference-correction amount conversion table 26 (step S1306).

The CPU 10F then reads out the present position (present opening amount) of the ink fountain key 4 from the present position memory 24, and corrects the read present opening amount of the ink fountain key 4 by the home position correction amount obtained in step S1306 (step S1307). More specifically, the present opening amount of the ink fountain key 4 is corrected by the home position correction amount obtained in step S1306 as the correction value. The CPU 10F then writes the corrected present opening amount in the present position memory 24 (step S1308). After that, the opening amount of the ink fountain key 4 is controlled with reference to the present opening amount of the ink fountain key 4 updated in step S1308.

In the first to sixth embodiments described above, the testing plate 7A having the color patch portion 7A1 and home position adjusting image portion 7A2 is used. However, the present invention is not limited to this. For example, a plate used in ordinary printing, which has images of almost the same areas in the right-to-left direction of the paper may be used in the same manner as the testing plate 7A. Alternatively, a plate for a printing product, the reference density of which is known in advance because printing is performed previously by using it, may be used.

In this case, when the testing plate 7A is to be used, printing must be performed by using the testing plate 7A. In contrast to this, when the plate for ordinary printing is to be used, a printing sample obtained by ordinary printing can be used, and the printing material and time may be economized.

Seventh Embodiment

Figure 14:
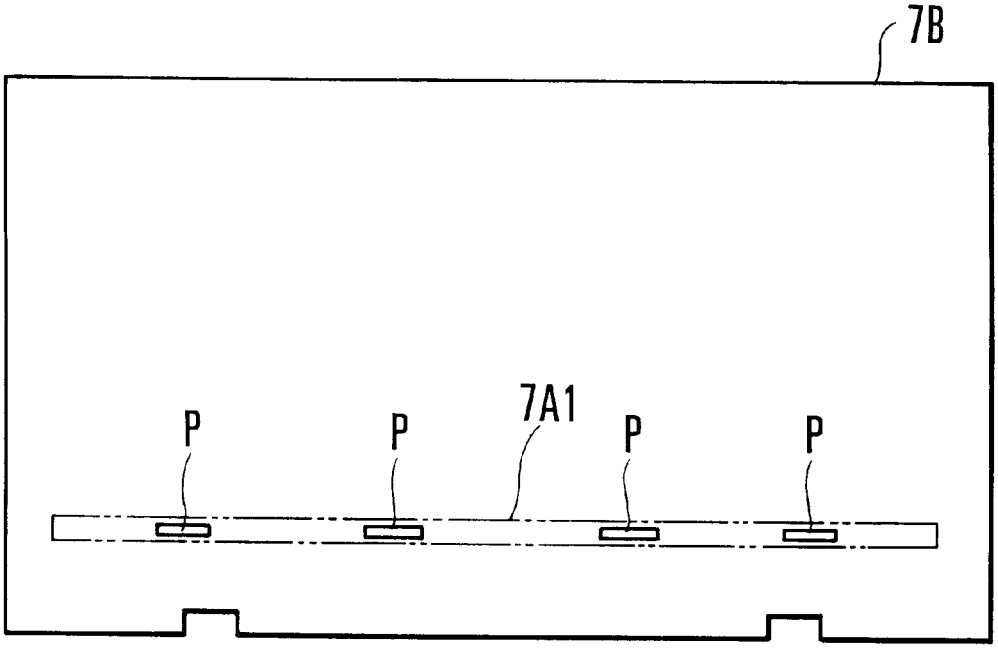
FIG. 14 is a plan view showing another example of a testing plate.

In the first to sixth embodiments described above, the testing plate 7A having the color patch portion 7A1 and home position adjusting image portion 7A2 is used. Alternatively, a testing plate 7B (FIG. 14) having only a color patch portion 7A1 may be used.

Figure 15:
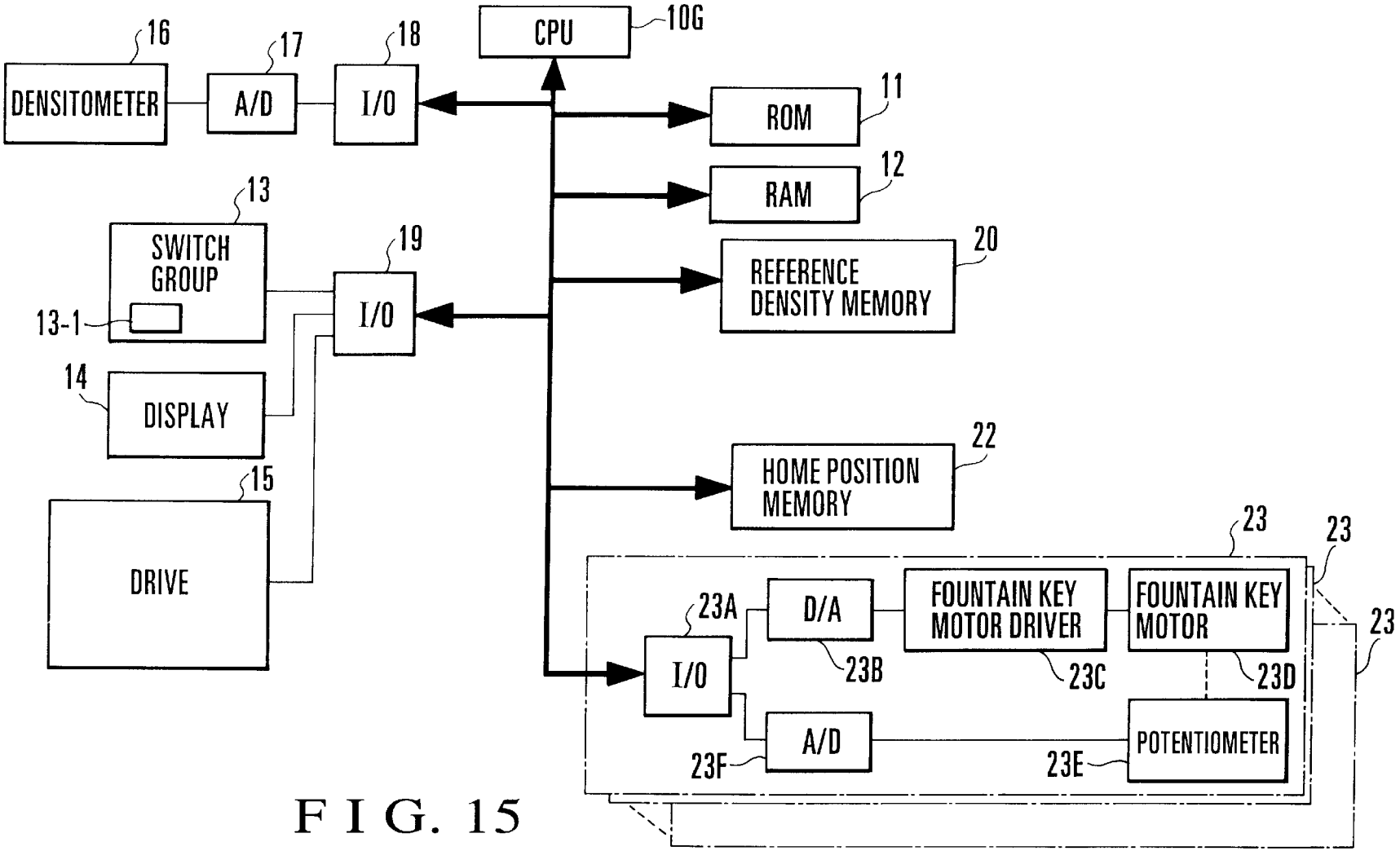
FIG. 15 is a block diagram of a home position correcting apparatus for ink fountain keys according to the seventh embodiment of the present invention.

FIG. 15 shows a home position correcting apparatus for ink fountain keys according to the seventh embodiment of the present invention. In FIG. 15, the same reference numerals as in FIG. 2 denote the same or equivalent constituent elements, and a detailed description thereof will be omitted. In the home position correcting apparatus of this embodiment, the preset position memory 21 shown in FIG. 2 is omitted.

Figure 16:
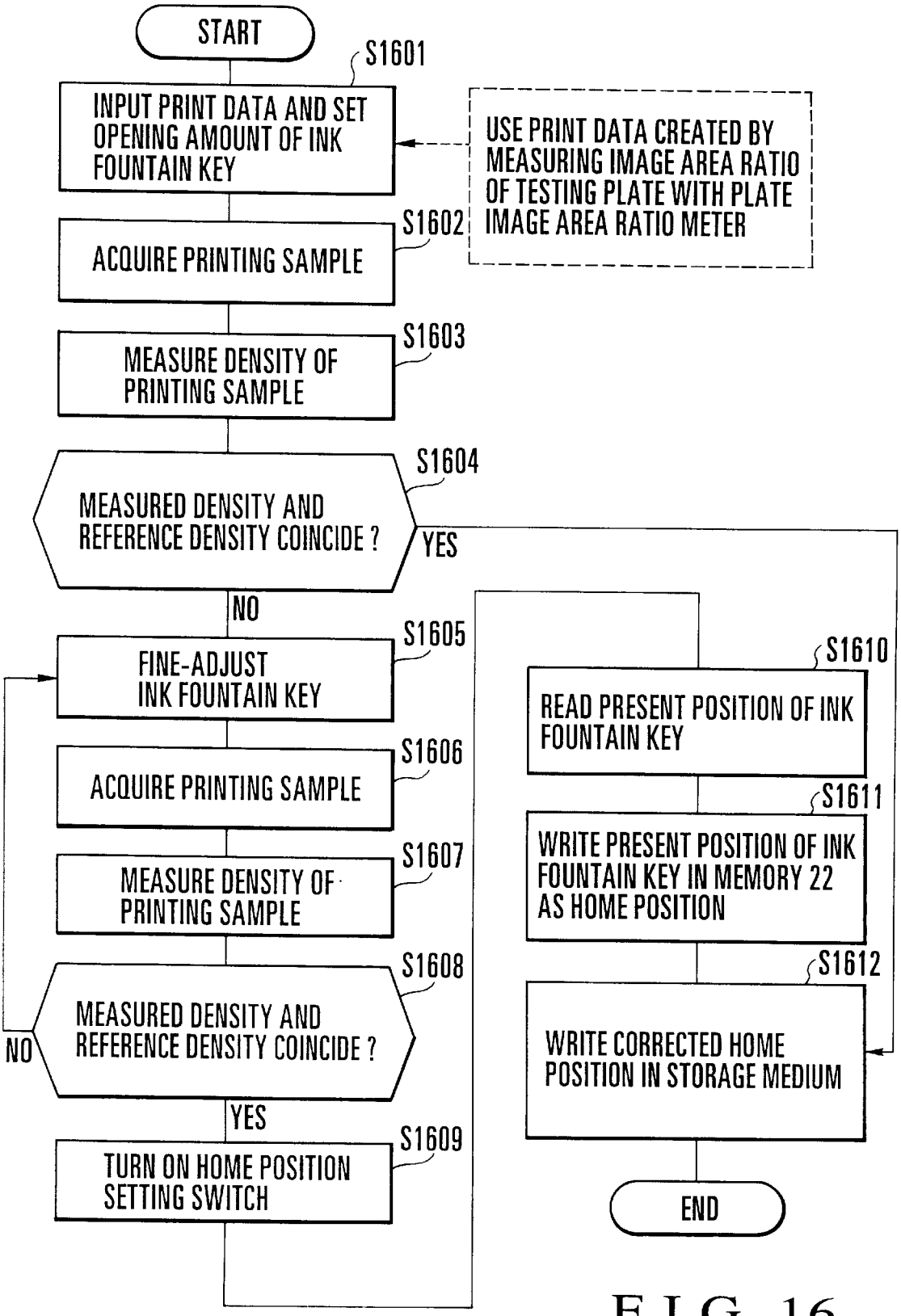
FIG. 16 is a flow chart explaining the correcting operation of the home position correcting apparatus shown in FIG. 15.

The correcting operation of the home position correcting apparatus having the above arrangement will be described with reference to the flow chart shown in FIG. 16. A testing plate 7B having only a color patch portion 7A1 is used in place of a testing plate 7A.

First, in steps S1601 to S1609, a CPU 10G performs the same operations as in steps S101 to S109 of FIG. 1. In step S1601, the CPU 10G measures the image area ratios of respective areas E of the testing plate 7B corresponding to ink fountain keys 4, and creates print data for the ink fountain keys 4 on the basis of the measured image area ratio. In steps S1602 and S1606, a printing sample J printed by using the testing plate 7B is acquired. In steps S1603 and S1607, the densities of patches p of the color patch portion 7A1 are measured by using the testing plate 7B.

The CPU 10G then turns on a home position setting switch 13-1 to read the opening amount of each ink fountain key 4, which is obtained when the measured density and the reference density coincide with each other (step S1601), and writes the read opening amount in a home position memory 22 as the home position of the ink fountain key 4 (step S1611). Finally, the CPU 10G writes the corrected home position in a storage medium (step S1612).

The present position of the ink fountain key 4 is written in the home position memory 22 as the home position because the position of the ink fountain key 4 set by using the testing plate 7B substantially having no image is the home position.

Eighth Embodiment

Figure 17:
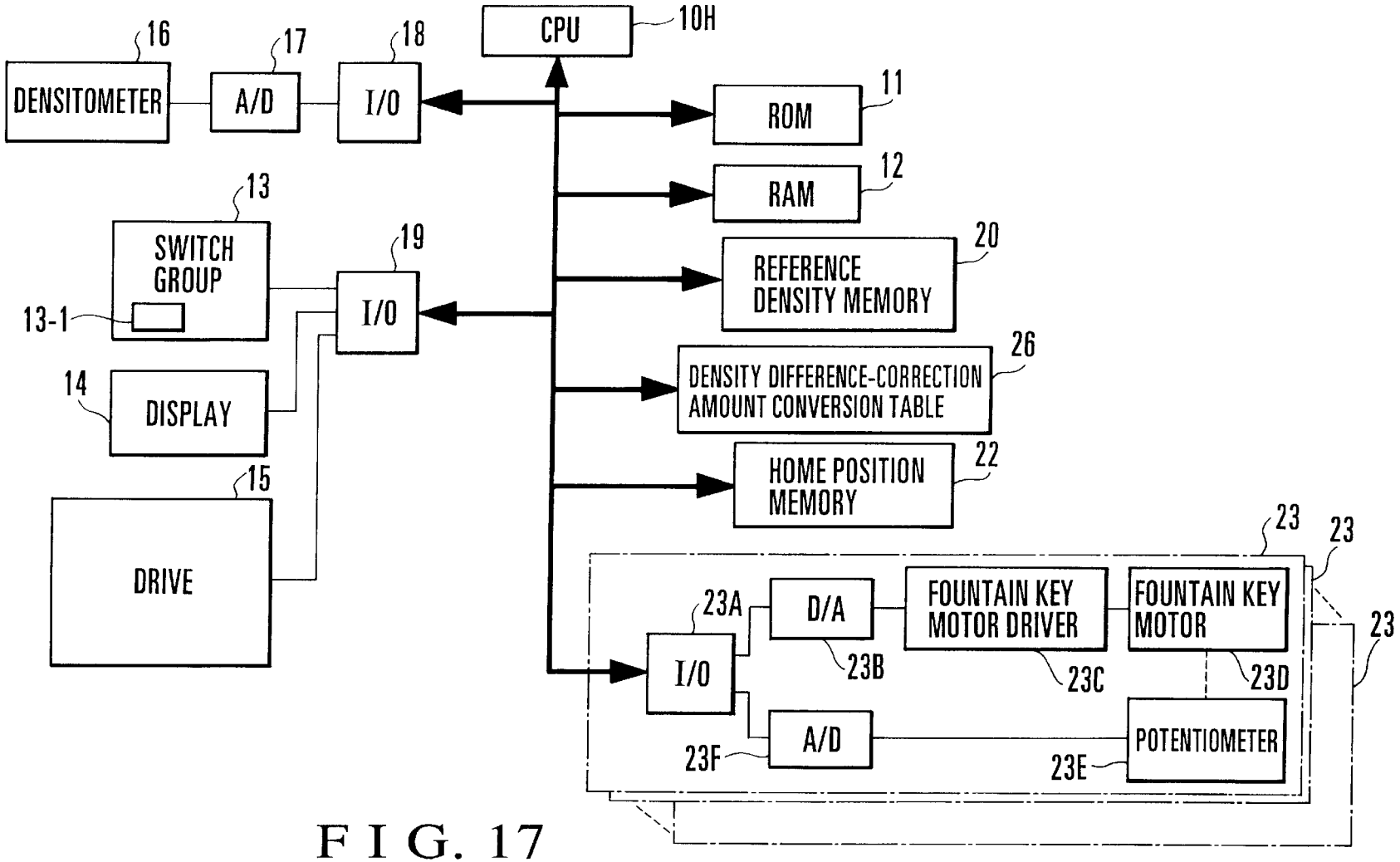
FIG. 17 is a block diagram of a home position correcting apparatus for ink fountain keys according to the eighth embodiment of the present invention.

FIG. 17 shows a home position correcting apparatus for ink fountain keys according to the eighth embodiment of the present invention. In FIG. 17, the same reference numerals as in FIGS. 2 and 19 denote the same or equivalent constituent elements, and a detailed description thereof will be omitted. In the home position correcting apparatus of this embodiment, a density difference-correction amount conversion table 26 is arranged in place of the preset position memory 21 shown in FIG. 2.

Figure 18:
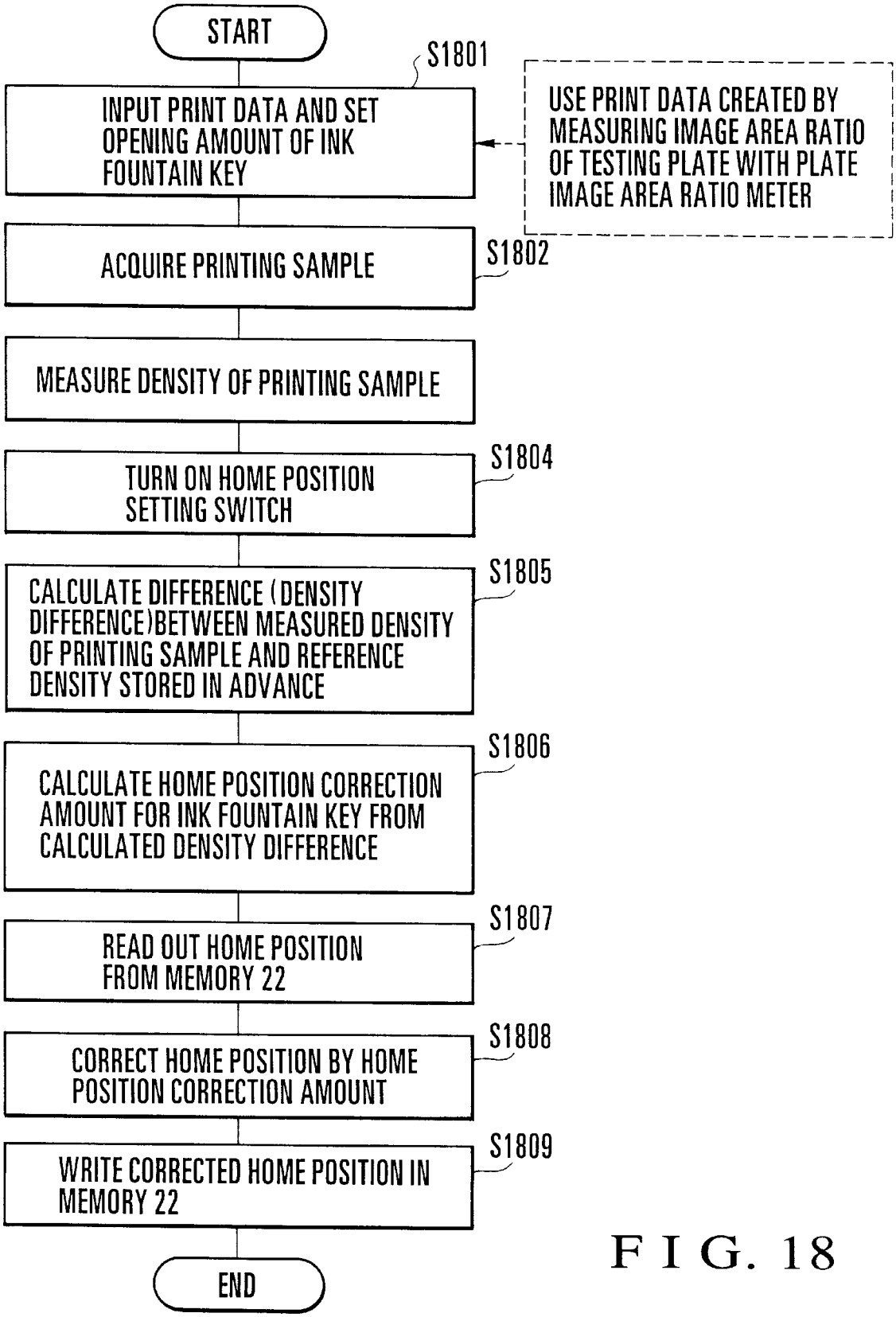
FIG. 18 is a flow chart for explaining the correcting operation of the home position correcting apparatus shown in FIG. 17.

The correcting operation of the home position correcting apparatus having the above arrangement will be described with reference to the flow chart shown in FIG. 18. A testing plate 7B having only a color patch portion 7A1 is used in place of a testing plate 7A.

Figure 7:
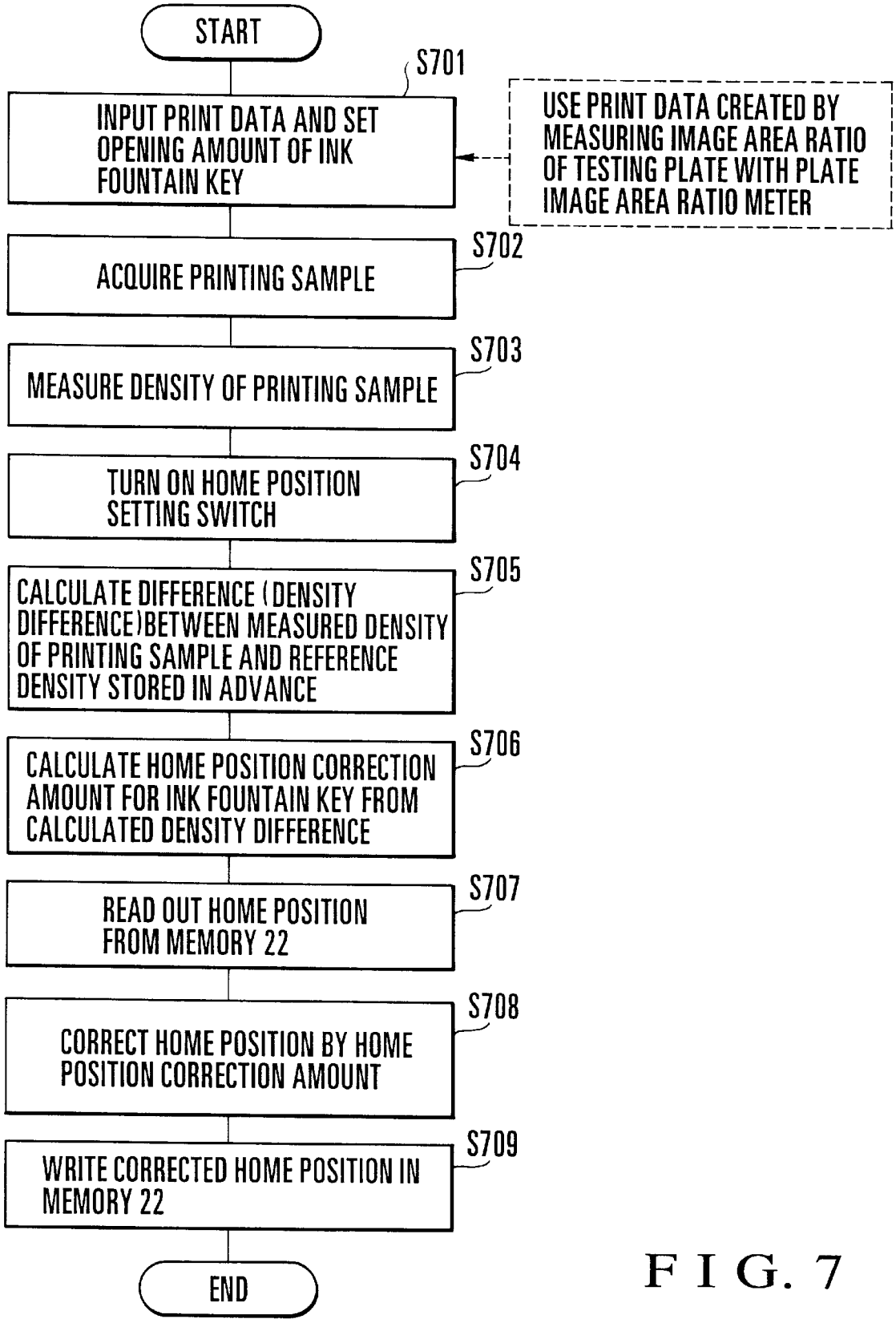
FIG. 7 is a flow chart explaining the correcting operation of the home position correcting apparatus shown in FIG. 6.

In steps S1801 to S1809, a CPU 10H performs the same operations as in steps S701 to S709 of FIG. 7. In step S1801, the CPU 10H measures the image area ratios of respective areas E, corresponding to ink fountain keys 4, of the testing plate 7B, and creates print data for the ink fountain keys 4 on the basis of the measured image area ratio. In steps S1802 and S1806, a printing sample J printed by using the testing plate 7B is acquired. In steps S1803 and S1807, the density of each patch p of the color patch portion 7A1 is measured by using the testing plate 7B.

Figure 21:
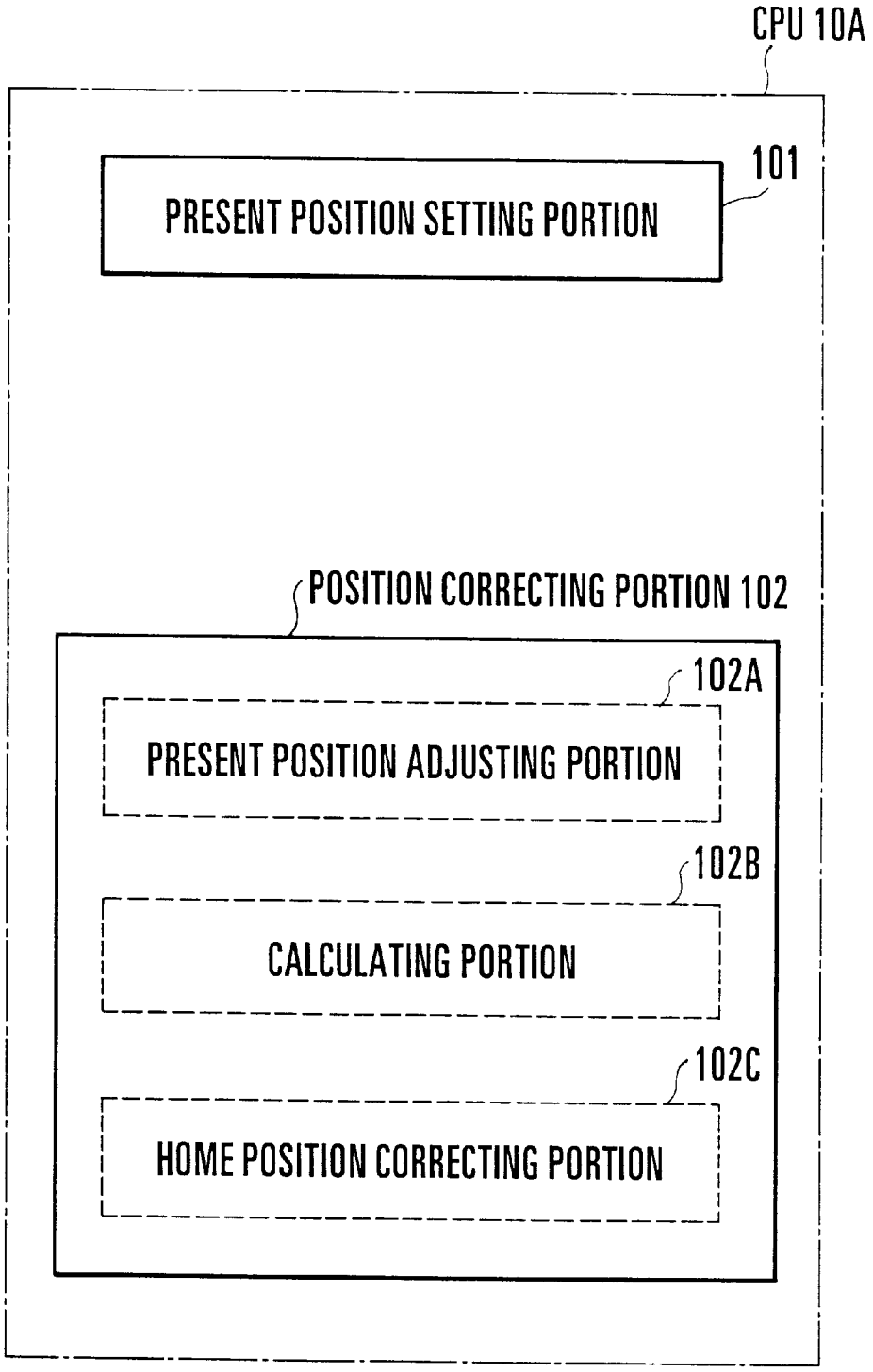
FIG. 21 is a view showing the functional block of the CPU shown in FIG. 2.

FIG. 21 shows the functional block of the CPU 10A shown in FIG. 2. Referring to FIG. 21, a present position setting portion 101 performs step S101 of FIG. 1. Of a position correcting portion 102, a present position adjusting portion 102A, a calculating portion 102B, and a home position correcting portion 102C perform steps S105 to S108, step S112, and step S114, respectively. The CPU 10B shown in FIG. 4 has the same functional block as this.

Figure 22:
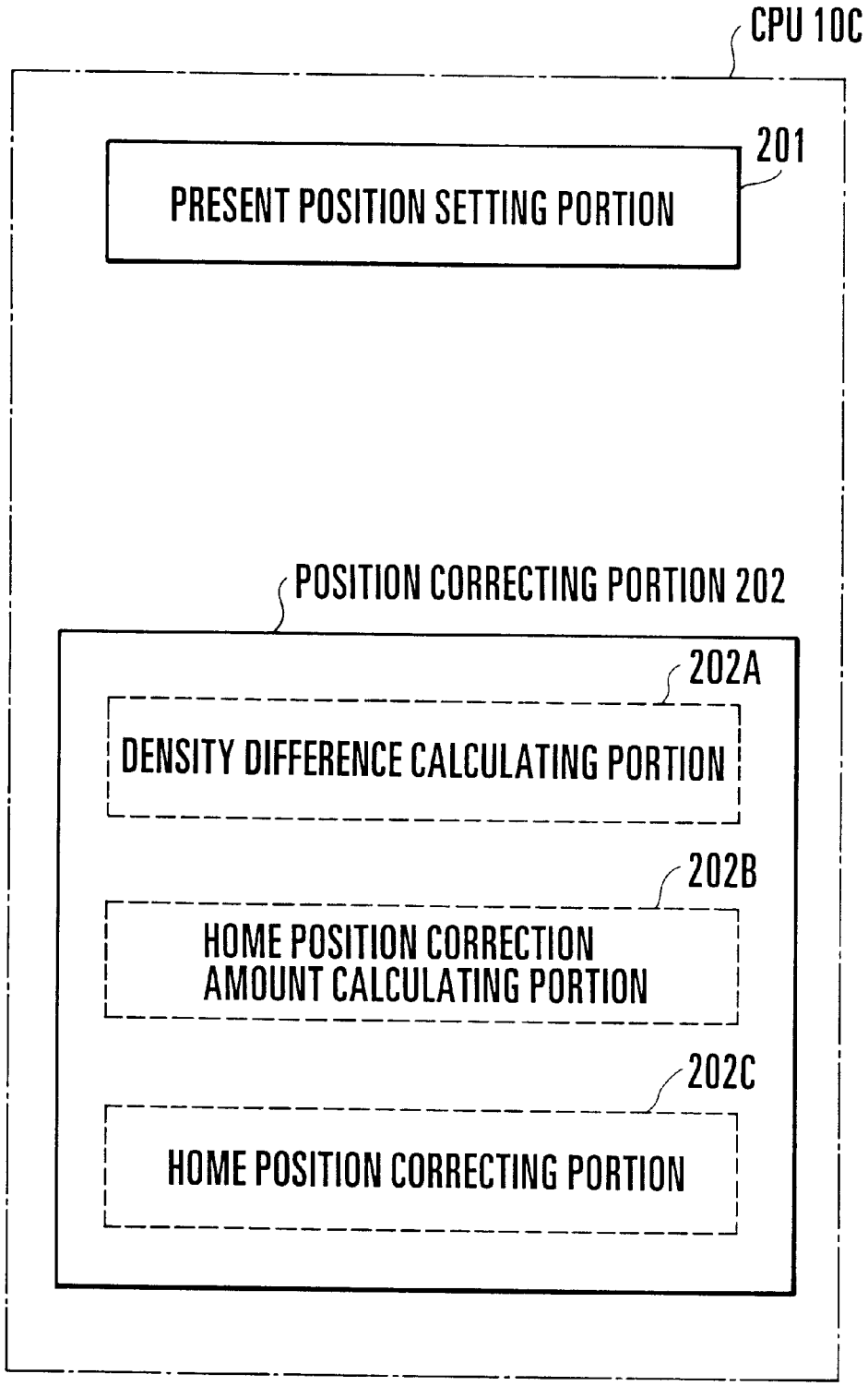
FIG. 22 is a view showing the functional block of the CPU shown in FIG. 6.

FIG. 22 shows the functional block of the CPU 10C shown in FIG. 6. Referring to FIG. 22, a present position setting portion 201 performs step S701 of FIG. 7. Of a position correcting portion 202, a density difference calculating portion 202A, a home position correction amount calculating portion 202B, and a home position correcting portion 202C perform step S705, step S706, and step S708, respectively. The CPU 10D shown in FIG. 8 has the same functional block as this.

Figure 23:
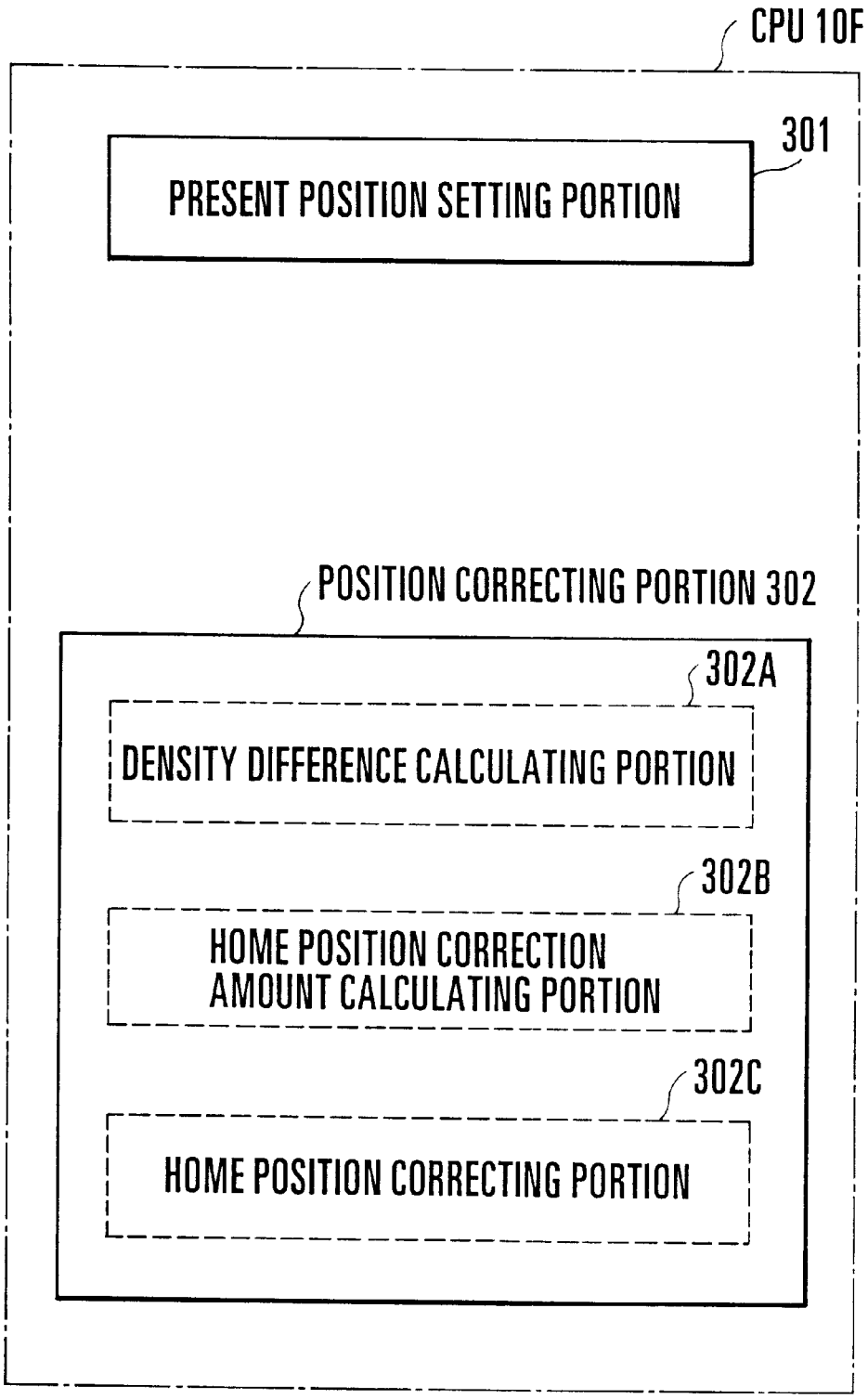
FIG. 23 is a view showing the functional block of the CPU shown in FIG. 12.

FIG. 23 shows the functional block of the CPU 10F shown in FIG. 12. Referring to FIG. 23, a present position setting portion 301 performs step S1301 of FIG. 13. Of a position correcting portion 302, a density difference calculating portion 302A, a home position correction amount calculating portion 302B, and a home position correcting portion 302C perform step S1305, step S1306, and step S1307, respectively.

As has been described above, according to the present invention, a printing product is obtained by using a plate having a predetermined image. The densities of the respective patches p of the obtained printing product corresponding to the respective ink fountain keys are measured. The home position and present position of each ink fountain key are corrected on the basis of the difference between the measured density of the corresponding patch p and the corresponding reference density stored in advance. The thickness of the ink on the ink fountain roller need not be measured by a measurement unit, or need not be adjusted by checking the color. As a result, the home positions and present positions of the ink fountain keys can be adjusted easily within a short period of time.

What is claimed is:

1. A method of correcting a position of an ink fountain key in a printing press, in which an amount of ink to be supplied is adjusted by adjusting a position of each of a plurality of ink fountain keys with reference to a home position, comprising the steps of:

setting a position of said ink fountain key as a present position with reference to a home position by using print data including an image area ratio of a reference plate having a predetermined image before actual printing;

printing a printing product by using said reference plate with said ink fountain key being set at the present position;

measuring a density of each of respective areas, corresponding to said ink fountain keys, of the obtained printing product;

correcting one of the home position and the present position of said ink fountain key on the basis of a difference between the measured density of a corresponding area and a reference density; and controlling an operating amount of said ink fountain key based on one of the corrected home position and the corrected present position of said ink fountain key which is stored in a memory when the actual printing is performed.

2. A method according to claim 1, wherein the correcting step comprises the step of adjusting the present position of said ink fountain key such that the difference between the measured density of said area and the reference density stored in advance falls within a predetermined range.

3. A method according to claim 2, further comprising the step of storing the present position of said ink fountain key with reference to the home position as a preset position.

4. A method according to claim 3, wherein the correcting step further comprises the steps of calculating the difference between the adjusted present position of said ink fountain key and the stored preset position of said ink fountain key, and correcting the home position of said ink fountain key in accordance with a calculation result obtained from the present position and the preset position of said ink fountain key.

5. A method according to claim 4, further comprising the step of updating and storing the corrected home position of said ink fountain key as the stored home position of said ink fountain key.

6. A method according to claim 2, wherein the correcting step further comprises the step of updating and storing the adjusted present position of said ink fountain key as the preset position of said ink fountain key.

7. A method according to claim 1, wherein the correcting step further comprises the steps of calculating a difference between the measured density of each area and the reference density stored in advance, calculating a correction amount for the home position of said ink fountain key from the calculated density difference, and correcting the home position of said ink fountain key on the basis of the calculated home position correction amount.

8. A method according to claim 1, wherein the correcting step further comprises the steps of calculating a density difference between the measured density of said area and the reference density stored in advance, calculating a correction amount for the home position of said ink fountain key from the calculated density difference, and calculating a corrected present position for said ink fountain key calculated by adding the calculated home position correction amount to the present position of said ink fountain keys.

9. A method according to claim 8, further comprising the step of updating and storing the stored home position of said ink fountain key by the corrected home position of said ink fountain key.

10. The method of claim 1 wherein said setting further comprises setting a position of an ink fountain key as the present position with reference to an original home position.

11. A position correcting apparatus for ink fountain keys in a printing press, in which an amount of ink to be supplied is adjusted by adjusting a position of each said ink fountain key of a plurality of ink fountain keys, comprising:

setting means for setting a position of said ink fountain key as a present position with reference to a home position by using print data including an image area ratio of a reference plate having a predetermined image before actual printing;

density measuring means for measuring a density of each of respective areas, corresponding to said ink fountain keys, of the obtained printing product by using a printing product printed by using said reference plate with each of said ink fountain keys being set at the present position;

position correcting means for correcting one of the home position and the present position of said ink fountain key on the basis of a difference between the measured density of a corresponding area measured by said density measuring means and a reference density; and controlling means for controlling an operating amount of said ink fountain key, based on one of the corrected home position and the corrected present position of said ink fountain key which is stored in a memory when the actual printing is performed.

12. An apparatus according to claim 11, wherein said position correcting means further comprises position adjusting means for adjusting the present position of said ink fountain key such that the difference between the measured density of said area and the reference density stored in advance falls within a predetermined range.

13. An apparatus according to claim 12, further comprising first storage means for storing the present position of said ink fountain key with reference to the home position as a preset position.

14. An apparatus according to claim 13, wherein said position correcting means further comprises calculating means for calculating the difference between the present position of said ink fountain key sent from said position adjusting means and the preset position of said ink fountain key stored in said first storage means, and correcting means for correcting the home position of said ink fountain key in accordance with a calculation result obtained from said calculating means.

15. An apparatus according to claim 14, further comprising second storage means for storing the home position of said ink fountain key and updating and storing the corrected home position of said ink fountain key as the home position of said ink fountain key.

16. An apparatus according to claim 12, further comprising first storage means for updating and storing the present position of said ink fountain key sent from said position adjusting means as the preset position of said ink fountain key.

17. An apparatus according to claim 11, wherein said position correcting means further comprises first calculating means for calculating a difference between the density of each area sent from said density measuring means and the reference density stored in advance, second calculating means for calculating a correction amount for the home position of said ink fountain key from the density difference calculated by said first calculating means, and home position correcting means for correcting the home position of said ink fountain key by using the correction amount calculated by said second calculating means.

18. An apparatus according to claim 11, wherein said position correcting means further comprises first calculating means for calculating a density difference between the measured density of each area and the reference density stored in advance, second calculating means for calculating a correction amount for the home position of said ink fountain key from the density difference calculated by said first calculating means, and third calculating means for calculating a present position for said ink fountain key corrected by adding the home position correction amount calculated by said second calculating means to the present position of said ink fountain key.

19. An apparatus according to claim 18, further comprising second storage means for storing the home position of said ink fountain key and updating and storing the corrected home position of said ink fountain key as the home position of said ink fountain key.

20. A method of correcting a home position of an ink fountain key comprising:

mounting a reference plate having a predetermined image on a printing press that includes said ink fountain key;

setting the present position of said ink fountain key with reference to the home position of the ink fountain key corresponding to an image area ratio of said reference plate, said setting of said present position in absence of actual printing on the reference plate;

printing a print product by using said reference plate with said ink fountain key set at the present position;

measuring a density of the print product associated with said ink fountain key; and correcting the home position of said ink fountain key based on a difference between the measured density of the print product associated with said ink fountain key and a reference density.

21. A method of correcting an ink fountain key position of an ink fountain key of a printing press, said method comprising:

setting a present position of said ink fountain key corresponding to a first print density value of a reference plate of said printing press, said setting of said present position corresponding with said key in absence of actual printing on the reference plate;

printing a printing product with said reference plate, said printing product having a second print density value corresponding with said key; and revising said present position to a corrected present position based on a difference between said first print density value and said second print density value to correct said ink fountain key position.

* * * * *